US008084179B2

(12) United States Patent
Hasegawa

(10) Patent No.: US 8,084,179 B2
(45) Date of Patent: Dec. 27, 2011

(54) ELECTROSTATIC IMAGE DEVELOPING TONER HAVING SPECIFIC VARIATION COEFFICIENT OF NUMBER DISTRIBUTION, TWO-COMPONENT DEVELOPER, IMAGE FORMING METHOD AND PROCESS CARTRIDGE

(75) Inventor: Kumi Hasegawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 433 days.

(21) Appl. No.: 12/092,585

(22) PCT Filed: Aug. 30, 2007

(86) PCT No.: PCT/JP2007/067353

§ 371 (c)(1),
(2), (4) Date: May 5, 2008

(87) PCT Pub. No.: WO2008/029863

PCT Pub. Date: Mar. 13, 2008

(65) Prior Publication Data

US 2009/0202934 A1 Aug. 13, 2009

(30) Foreign Application Priority Data

Sep. 4, 2006 (JP) ..... 2006-238768
Sep. 13, 2006 (JP) ..... 2006-247913

(51) Int. Cl.
*G03G 9/08* (2006.01)
*G03G 13/045* (2006.01)
*G03G 13/20* (2006.01)

(52) U.S. Cl. ..... 430/110.1; 430/108.1; 430/109.4; 430/110.4; 430/111.4; 430/119.86; 430/123.5; 430/124.1; 430/124.13; 430/124.3

(58) Field of Classification Search ..... 430/108.1, 430/109.4, 110.1, 110.4, 111.4, 119.86, 123.5, 430/127.1, 124.1, 3, 124.3
See application file for complete search history.

(56) References Cited

U.S. PATENT DOCUMENTS

| | | | | |
|---|---|---|---|---|
| 5,744,278 | A * | 4/1998 | Ayaki et al. | 430/109.3 |
| 5,747,210 | A | 5/1998 | Emoto et al. | |
| 6,077,635 | A * | 6/2000 | Okado et al. | 430/45.54 |
| 6,221,549 | B1 | 4/2001 | Emoto et al. | |
| 6,303,257 | B1 | 10/2001 | Hasegawa et al. | |
| 6,432,590 | B1 | 8/2002 | Ueda et al. | |
| 6,468,706 | B2 | 10/2002 | Matsuda et al. | |
| 6,544,704 | B1 | 4/2003 | Matsuda et al. | |
| 6,696,211 | B2 * | 2/2004 | Yoshida et al. | 430/108.3 |
| 6,899,986 | B2 | 5/2005 | Aoki et al. | |
| 6,924,073 | B2 | 8/2005 | Higuchi et al. | |
| 6,934,482 | B2 | 8/2005 | Iwai | |
| 7,029,816 | B2 | 4/2006 | Sasaki et al. | |
| 7,110,696 | B2 | 9/2006 | Murakami et al. | |
| 7,150,954 | B2 | 12/2006 | Aoki et al. | |
| 7,157,198 | B2 * | 1/2007 | Ohmura et al. | 430/108.1 |
| 7,163,774 | B2 | 1/2007 | Shiraishi et al. | |
| 7,183,029 | B2 | 2/2007 | Masuda et al. | |
| 7,205,082 | B2 * | 4/2007 | Matsushima et al. | 430/108.5 |
| 7,217,485 | B2 | 5/2007 | Hasegawa et al. | |
| 7,272,354 | B2 | 9/2007 | Murakami et al. | |
| 7,522,857 | B2 | 4/2009 | Hasegawa et al. | |
| 2001/0031414 | A1 | 10/2001 | Yoshida et al. | |
| 2002/0039698 | A1 | 4/2002 | Sasaki et al. | |
| 2003/0186146 | A1 | 10/2003 | Shibata et al. | |
| 2004/0228648 | A1 | 11/2004 | Yanagida et al. | |
| 2005/0084787 | A1 | 4/2005 | Kobayashi et al. | |
| 2005/0158648 | A1 | 7/2005 | Makino et al. | |
| 2006/0051692 | A1 | 3/2006 | Hasegawa et al. | |
| 2006/0068306 | A1 | 3/2006 | Shu et al. | |
| 2006/0093943 | A1 | 5/2006 | Shu et al. | |
| 2006/0165431 | A1 | 7/2006 | Yanagida et al. | |
| 2007/0207401 | A1 | 9/2007 | Shirai | |
| 2008/0102393 | A1 * | 5/2008 | Hasegawa | 430/109.3 |
| 2009/0176169 | A1 * | 7/2009 | Hasegawa | 430/108.3 |

FOREIGN PATENT DOCUMENTS

| | | | |
|---|---|---|---|
| CN | 1550933 | A | 12/2004 |
| EP | 1 128 224 | A2 | 8/2001 |
| EP | 1 653 289 | A2 | 5/2006 |
| JP | 2 157765 | | 6/1990 |
| JP | 2-284155 | A | 11/1990 |
| JP | 6 3853 | | 1/1994 |
| JP | 10 111629 | | 4/1998 |
| JP | 2859635 | B2 | 12/1998 |
| JP | 2896826 | | 3/1999 |
| JP | 11-190913 | | 7/1999 |
| JP | 2981803 | B2 | 9/1999 |
| JP | 2000-47432 | A | 2/2000 |
| JP | 2001 296781 | | 10/2001 |

(Continued)

OTHER PUBLICATIONS

Machine translations of JP 2001-312,092; JP 2004-050459; and JP 2004-198,692.*

Office Action issued May 31, 2011, in Chinese Application No. 200780001414.4 (with English-language Translation).

Supplementary European Search Report issued Jul. 29, 2011, in European Application No. 07 80 6795.6.

*Primary Examiner* — H. (Holly) T Le

(74) *Attorney, Agent, or Firm* — Oblon, Spivak, McClelland, Maier & Neustadt, L.L.P.

(57) ABSTRACT

A toner including: toner particles which include: a colorant, a releasing agent, and a binder resin. The number average particle diameter of the toner particles is in the range of from 3.5 μm to 6.5 μm, wherein the number average particle diameter is determined by the Coulter method, the variation coefficient of the number distribution of the toner particles is in the range of 22.0 to 35.0, wherein the variation coefficient is found by dividing the standard deviation of the number distribution by the number average particle diameter, and 40% by number to 59% by number of the toner particles are 4.0 μm to 8.0 μm in diameter.

12 Claims, 7 Drawing Sheets

FOREIGN PATENT DOCUMENTS

| | | |
|---|---|---|
| JP | 2001-312092 | 11/2001 |
| JP | 2003 43725 | 2/2003 |
| JP | 2003 107777 | 4/2003 |
| JP | 2003-302796 | 10/2003 |
| JP | 2004-54059 | 2/2004 |
| JP | 2004-109233 | 4/2004 |
| JP | 2004-117465 | 4/2004 |
| JP | 2004 117465 | 4/2004 |
| JP | 2004-198692 | 7/2004 |
| JP | 2004 271881 | 9/2004 |
| JP | 2004 309745 | 11/2004 |
| JP | 2005 99726 | 4/2005 |
| JP | 2005 172936 | 6/2005 |
| JP | 2005-196142 | 7/2005 |
| JP | 2005-308995 | 11/2005 |
| JP | 2005 350510 | 12/2005 |
| JP | 2006 3418 | 1/2006 |
| JP | 2006 47585 | 2/2006 |
| JP | 2006 78707 | 3/2006 |
| JP | 2006 146013 | 6/2006 |
| JP | 2006-154528 | 6/2006 |
| JP | 2006 227241 | 8/2006 |

* cited by examiner

Grade 5

Grade 3

Grade 1

ELECTROSTATIC IMAGE DEVELOPING TONER HAVING SPECIFIC VARIATION COEFFICIENT OF NUMBER DISTRIBUTION, TWO-COMPONENT DEVELOPER, IMAGE FORMING METHOD AND PROCESS CARTRIDGE

TECHNICAL FIELD

The present invention relates to an electrostatic image developing toner, a two-component developer using the same, an image forming method and a process cartridge.

BACKGROUND ART

In recent years, small copiers that can swiftly form a great number of high-quality images and can maintain that ability over a long period of time are in high demand; however, not all recent fast-copiers have been successfully downsized. That is partially because the required space for housing collected toner particles remaining after transferring toner images is large in copiers. On the other hand, collecting toner particles is important in terms of the environment, and handling the remaining toner particles has greatly gathered concerns. The forementioned problems can be solved by reusing the remaining toner particles in image developing. By this means, small and fast-copiers that enable to reduce their environmental load can be successfully achieved. As reusing the collected toner particles enables to produce a greater number of copies on the same amount of supplied toner than those not reusing them, such fast-copiers have great economical advantages.

Many attempts have been made to collect and reuse the remaining toner particles. Unfortunately, those attempts cannot maintain ability of stably forming high quality images over a long period of time. This is because image quality and image density degrade and chances of other problems being caused increases at every copy produced in such systems.

Patent Literature 1 proposes collecting and reusing toner particles whose particle size distribution is adjusted in a certain range so that it enables to form high quality images over a long period of time. In the proposed toner, 90% by mass or more of toner particles have a diameter from $D(3\sqrt{2})-1$ to $3\sqrt{2}D$, and 5% by mass or less have a diameter smaller than $D(3\sqrt{2})-1$, where D is the volume average particle diameter of the particles. That proposed toner, exclusively used in two-component developments, contains a small proportion of very small toner particles so that it has advantages that toner scattering as well as fogging (which commonly occurs where toner particles are collected to be reused) can be prevented. Unfortunately, the proposed toner cannot provide high-resolution images. This is because it contains insufficient proportion of small toner particles for forming the fine images.

Patent Literature 2 proposes a toner having another specific particle size distribution; however, carrier spent is yet to be decreased and the occurrence of fogging is yet to be prevented in the proposed toner.

On the other hand, toners containing a large amount of fine particles for forming high-resolution images have some disadvantages when removing remaining particles of such toners from the surface of a photoconductor after the forming of images. One of the disadvantages arises when such toner is used in a system where a cleaning blade is used as means to clean the surface of the photoconductor after the forming of an image. Fine particles which have not transferred, or particles remaining on the photoconductor, are hardly removed with the blade.

Another disadvantage of such toner is that a wax and inorganic particulates are easily detached from the toner particles, attached on the photoconductor. The wax is internally or externally added to the toner in order to improve its releasing property. The inorganic particulates are added to the toner in order to improve its flowability. In smaller toner particles, the proportion of those additives increases in the particles, thus using such smaller particles tends to cause greater amount of such additives to adhere on the photoconductor.

An example of a cleaning unit for removing attached substances from the photoconductor is found in Patent Literature 3. The proposed cleaning unit contains a cleaning blade and a cleaning roller whose surface is covered with an abrasive. Unfortunately, as the abrasive particles covering the surface of the roller easily come off, the proposed technique has difficulty in maintaining its cleaning capability over a long period of time. Another cleaning unit proposed in Patent Literature 4 contains a cleaning blade provided with glued abrasive particles at its edge. One of the disadvantages is that removing both the remaining toner particles and attached substances at the same time is significantly difficult using that blade. Another disadvantage is that the abrasive particles easily come off from the edge.

As described above, removing attached substances from the surface of the photoconductor with such a conventional cleaning blade or a conventional cleaning unit containing such cleaning roller has not achieved a satisfactory result. As a result, unremoved attached substances cause filming when they mainly consist of wax. They degrade image quality over time when they mainly consist of inorganic particulates which serve as cores of growing attached substances.

For the above-stated reason, the inventors of the present invention proposed a cleaning unit found in Patent Literature 5. It suggests using two different blades, a first blade and a second blade, where the second blade is a sanding blade composed of a base and an abrasive particle-containing layer. Around a photoconductor, the first and second cleaning blades are provided at the upper stream and down stream, respectively, of the rotation direction of the photoconductor. Although the proposed cleaning unit can effectively remove remaining toner particles and attached substances from the surface of the photoconductor, it is still not an effective means for removing fine toner particles having a narrow particle size distribution. Thus, cleaning units that can effectively remove such toner particles have been highly demanded.

[Patent Literature 1]: Japanese Patent Application Laid-Open (JP-A) No. 02-157765

[Patent Literature 2]: Japanese Patent (JP-B) No. 2896826

[Patent Literature 3]: JP-A No. 10-111629

[Patent Literature 4]: JP-A No. 2001-296781

[Patent Literature 5]: JP-A No. 2004-117465

DISCLOSURE OF INVENTION

The first aspect of the present invention is to solve the forementioned problems, and to provide an electrostatic image developing toner that enables both forming high quality images and lowering fixing temperature in a system where toner particles are collected and reused, when the toner particles have a small diameter and a narrow particle size distribution. It is further to provide a two-component developer using the toner, an image forming method and a process cartridge.

The second aspect in the present invention is to provide an image forming method with a toner whose particles have a small diameter and a narrow particle size distribution. In the method, remaining or untransferred toner particles as well as attached substances on the surface of a photoconductor are effectively removed, and that cleaning capability is maintained over a long period of time. The present invention is further to provide an image forming method containing a cleaning step which can provide the above-stated excellent cleaning capability and can maintain that capability over a long period of time, and to provide a process cartridge containing the image forming method.

The inventors of the present invention established that, in the system where toner particles are collected and reused, using a toner having a specific variation coefficient of its mass distribution and a specific particle size distribution can prevent the over-time degradation in image quality, when the toner particles have a small diameter and a narrow particle size distribution.

The inventors of the present invention also established that, among many proposed cleaning units and toners, using a specific cleaning unit with a specific toner whose particles have a small diameter and a narrow particle size distribution can achieve the following advantages: the toner particles have excellent removability from the surface of a photoconductor; images with excellent sharpness and density can be obtained; the occurrence of image fogging can be prevented; and, both the removability of the particles and the capability of forming such images can be maintained for a long period of time.

The present invention is based on the above findings by the inventors. The methods to solve the forementioned problems are as follows:

<1>. A toner, including:

a colorant, a releasing agent, and a binder resin, wherein the number average particle diameter (D1) of the toner is in the range of from 3.5 μm to 6.5 μm as determined by the Coulter method, the variation coefficient of the number distribution of the toner is in the range of 22.0 to 35.0, the variation coefficient being found by dividing the standard deviation of the number distribution by the number average particle diameter (D1), and 40% by number to 59% by number of the toner are 4.0 μm to 8.0 μm in diameter.

<2>. The toner according to <1>, wherein 15% by number to 35% by number of the toner are 4.0 μm to 5.0 μm in diameter.

<3>. The toner according to one of <1>and <2>, wherein the weight average particle diameter (D4) of the toner is in the range of 3.5 μm to 5.5 μm.

<4>. The toner according to any one of <1> to <3>, wherein the ratio of D4 to D1 is in the range of from 1.04 to 1.30.

<5>. The toner according to any one of <1> to <4>, wherein the loose apparent density of the toner is in the range of 0.30 g/cm$^3$ to 0.39 g/cm$^3$.

<6>. The toner according to any one of <1> to <5>, wherein the binder resin contains a polyester resin produced by using an inorganic tin (II) compound as a catalyst, and the peak top molecular weight (Mp) of the toner is in the range of 4,000 to 8,000, as determined by gel permeation chromatography (GPC).

<7>. The toner according to any one of <1> to <6>, wherein the ½ flow temperature of the toner is in the range of 145° C. to 165° C., the ½ flow temperature being determined with a flow tester.

<8>. The toner according to any one of <1>to <7>, wherein the binder resin contains a hybrid resin composed of a vinyl polymerization unit and a polyester unit that is produced by using the inorganic tin (II) compound as a catalyst, and the content A of the hybrid resin and the content B of the releasing agent satisfy the condition:

$$(1/2)\times B \leqq A3.$$

<9>. The toner according to any one of <6> to <8>, wherein the inorganic tin (II) compound is tin (II) octylate.

<10>. A two-component developer, including the toner according to any one of <1> to <9>, and a carrier.

<11>. An image forming method, including:

charging a surface of an image bearing member, exposing the surface to form a latent electrostatic image, developing the latent electrostatic image into a visible image with a toner, transferring the visible image to a recording medium, fixing the thus transferred visible image onto the recording medium, and removing remaining toner from the surface, wherein the toner is any one of the toners according to <1> to <9>.

<12>. The image forming method according to <11>, further including collecting the removed toner to reuse the same in developing a latent electrostatic image.

<13>. The image forming method according to one of <11> and <12>, wherein the recording medium is fed in between a fixing roller and a pressure roller to fix the visible image, the fixing roller applying heat to the recording medium to fix the visible image, the wall thickness of the fixing roller being 1.0 mm or thinner, and pressure applied to a unit area of the surface of one of the rollers by the surface of the other roller is $1.5\times10^5$ Pa or lower, where the pressure is calculated by dividing load between the rollers by the contact area thereof.

<14>. The image forming method according to any one of <11> to <13>, wherein the removing of the remaining toner is performed with a cleaning unit configured to clean the surface of the image bearing member, the cleaning unit being composed of a first cleaning blade and a second cleaning blade which are located at the upstream and downstream, respectively, of the rotation direction of the image bearing member, the second cleaning blade being composed of a base and an abrasive particle-containing layer as a sanding blade.

<15>. A process cartridge, including:

a latent electrostatic image bearing member, a developing unit, and a cleaning unit, wherein the developing unit is configured to develop a latent electrostatic image on a surface of the image bearing member with a toner to form the image into a visible image, the cleaning unit is configured to remove remaining toner from the surface of the image bearing member, and the toner is any one of the toners according to <1> to <9>.

<16>. The process cartridge according to <15>, wherein the cleaning unit is configured to clean the surface of the image bearing member, the cleaning unit being composed of a first cleaning blade and a second cleaning blade which are located at the upstream and downstream, respectively, of the rotation direction of the image bearing member, the second cleaning blade being composed of a base layer and an abrasive particle-containing layer as a sanding blade.

BEST MODE FOR CARRYING OUT THE INVENTION

Toner

Figure 1:
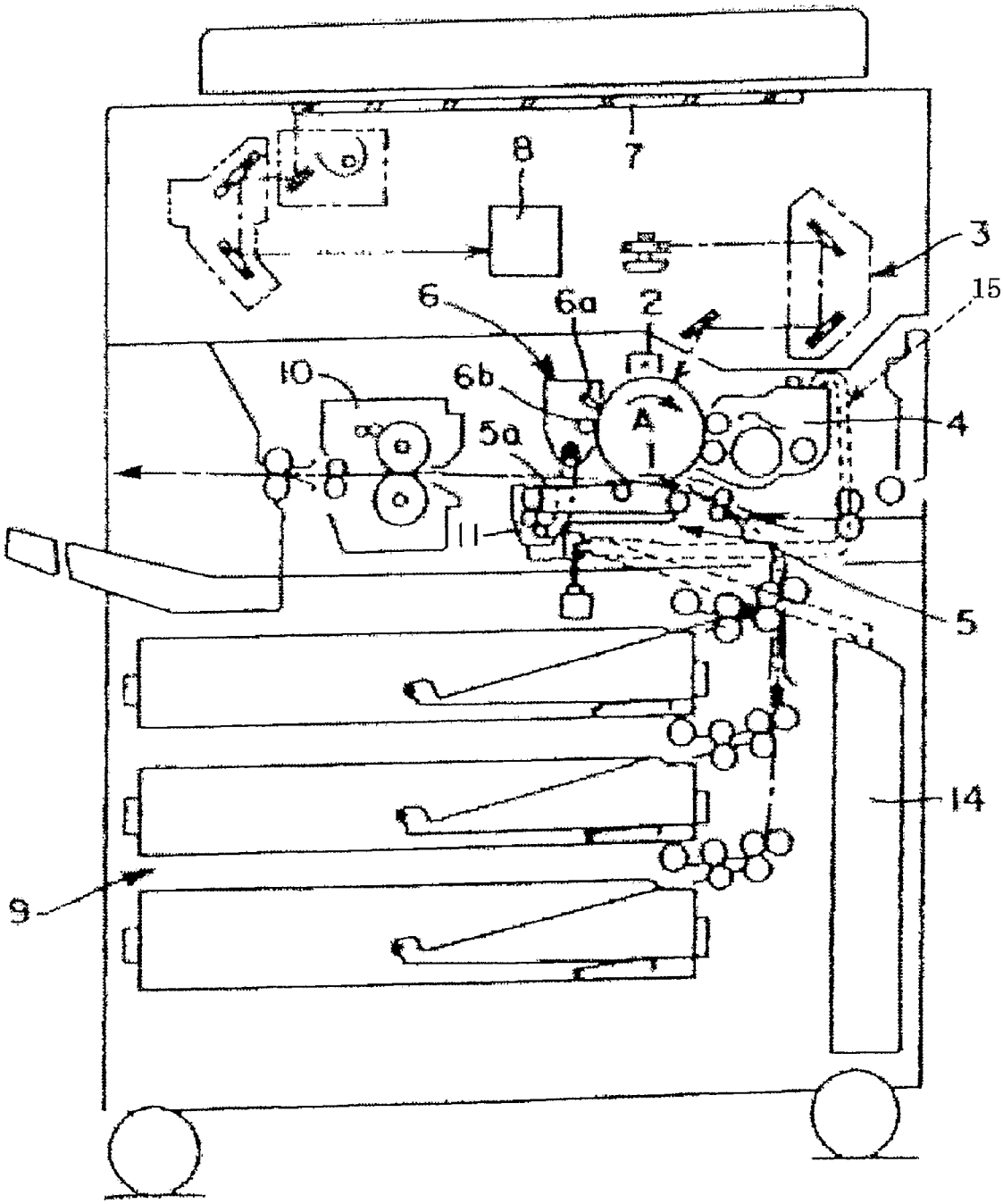
FIG. 1 is a schematic view exemplarily showing a digital copier using the toner of the present invention for forming images.

The toner of the present invention contains at least a colorant, a releasing agent and a binder resin, and further contains other ingredients as necessary.

In order to enable the toner of the present invention to both form high quality images and be fixed at a low fixing temperature, it is essential that the toner have a number average particle diameter, measured by the Coulter counter method, from 3.5 μm to 6.5 μm; a variation coefficient of the number distribution of the toner particles from 22.0 to 35.0 (where the variation coefficient is obtained by dividing the standard deviation of the number distribution by the number average particle diameter); and a content of toner particles having a diameter from 4.0 μm to 8.0 μm from 40% by number to 59% by number.

When the number average particle diameter is smaller than 3.5 μm, removing the toner particles from the surface of a photoconductor may become difficult, resulting in frequent occurrences of image fogging. And when it is larger than 6.5 μm, the sharpness of characters will be degraded. When the variation coefficient is in the range of 22.0 to 35.0, it is possible to minimize the changes in the flowability and electrostatic chargeability of the toner, when the toner is used in a toner a system where the toner particles that have not used, or initial toner particles, are mixed with collected toner particles. And thus high quality images can be obtained over a long period of time on the toner. When the variation coefficient is less than 22.0, or the tone has a narrow particle size distribution, the toner can produce high quality images at the beginning; however, the particle size distributions of the initial toner particles and the collected toner particles will be clearly distinguished from each other over time. As a result, mainly the initial toner particles are used in developing images, while most of the collected toner particles are left and accumulated in a toner housing section over time, increasing carrier spent and causing the aggregation of a developer. Likewise, when the variation coefficient is larger than 35.0, or the tone has a wide particle size distribution, mainly toner particles having a certain particle size distribution are used for developing images, causing the same problems as stated above. For those reasons, the toner preferably has a variation coefficient from 22.0 to 35.0. When it is in the range, it is possible to prevent the collected toner particles from not being used for developing images when they are mixed with initial toner particles.

In terms of a desired particle size distribution for obtaining an excellent fixation characteristic, the particle diameters of the toner are preferably in the range of 4.0 μm to 8.0 μm. When they are smaller than 4.0 μm in diameter, the toner particles are easily buried in hollows on the surface of paper. In such cases, sufficient nip pressure cannot be applied to the toner particles in a fixing step, resulting in the occurrence of fixation failures. And further, toner particles smaller than 4.0 μm have a high thermal conductivity. Because of the high thermal conductivity, the toner particles are tend to be crushed and spread into a wide area on paper, degrading the granularity of images. On the other hand, particles larger than 8.0 μm have a poor thermal conductivity, degrading the fixation characteristic. Particles whose diameter is in the range of from 4.0 μm to 8.0 μm have the most preferable thermal conductivity for providing an excellent fixation characteristic and enabling to form high granularity images by preventing them from being crushed in fixation step. It is necessary that the toner contain the particles whose diameter is in that above-stated range in the range of 40% by number to 59% by number. The problem of when the content is higher than 59% by number, or toner having a narrow particle size distribution, is that mainly either collected or initial toner particles are used for developing images when the collected and initial toner particles are mixed. When the content is lower than 40% by number, the granularity of images may be degraded.

In order to improve the granularity, the content of particles whose diameter is in the range of 4.0 μm to 5.0 μm in the toner having the above-stated content of 4.0 μm to 8.0 μm particles is preferably in the range of from 15% by number to 35% by number. This toner can be provided and fixed thinly and uniformly on paper, thus it has advantage in forming images having a high density with a small amount of toner. When the content is less than 15% by number, the toner may not be able to sufficiently provide such advantage. And when that is higher than 35% by number, particle size distributions of the initial toner particles and the collected toner particles may be clearly distinguished from each other over time, preventing the collected toner particles from being used for developing images.

The weight average particle diameter (D4) of the toner particles is preferably in the range of from 3.5 μm to 5.5 μm and more preferably in the range of from 4.4 μm to 5.5 μm. When the weight average particle diameter (D4) of the toner is smaller than 3.5 μm, the toner particles are easily buried in hollows at the surface of paper. In such a case, the nip pressure may not be uniformly applied to the toner particles in a fixing step, and thus the fixation characteristic of the toner may be degraded. And when it is larger than 5.5 μm, the thermal conductivity of the toner decreases, and thus fixation characteristic may become poor.

Ratio D4/D1, where D1 is the number average particle diameter of the toner particles, is preferably in the range of from 1.04 to 1.30 and more preferably in the range of from 1.04 to 1.20. When the ratio D4/D1 is less than 1.04, the narrow particle size distribution of the toner may prevent the toner particles from being removed from the surface of a photoconductor. When it is larger than 1.30, image fogging may be easily caused.

For measuring the particle size distribution of the toner particles, the Coulter counter method with, for example, Coulter Counter TA-II or Coulter Multisizer II (both manufactured by Beckman Coulter, Inc.) can be used. It should be noted that different measurement devices offer completely different sensitivities for detecting the number distribution of particles particularly when the diameters of the particles are in the range of 2.0 μm to 5.0 μm. The measurement method will be described below in more detail.

First, 0.1 mL to 5 mL of a surfactant (preferably polyoxyethylene alkylether) is added as a dispersant to 100 mL to 150 mL of an electrolytic water solution. Here, the electrolytic water solution is 1% NaCl aqueous solution prepared using 1st grade sodium chloride. Second, 2 mg to 20 mg of a measurement sample is added into the solution. Subsequently, the sample is dispersed into the solution using an ultrasonic dispersing machine for 1 to 3 minutes. Using the above-stated measurement device with a 100 μm aperture, the mass of the toner particles and/or the toner and the number of the toner particles can be measured. Based on the thus obtained results, the mass distribution and the number distribution can be obtained. The volume average particle diameter (D4) and number average particle diameter can be obtained from the thus obtained distributions.

The channels are 13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm are used, or that is to say, the particles having a diameter of 2.00 μm to less than 40.30 μm can be measured.

The loose apparent density (LAD) of the toner is preferably in the range of 0.30 g/cm$^3$ to 0.39 g/cm$^3$. In general, toners having a larger loose apparent density have better flowability, electrostatic chargeability and storage stability. However, when the loose apparent density is larger than 0.39 g/cm$^3$, collected toner particles may not be uniformly dispersed in other toner particles, frequently resulting in the aggregation of the collected toner particles in the developing section. When the loose apparent density is smaller than 0.30 g/cm$^3$, the flowability of the toner will be insufficient, and it may make the toner particles difficult to be supplied to the surface of a photoconductor and cause the generation of toner aggregated articles.

The loose apparent density (g/cm$^3$) of the toner can be measured with 1H-2000 (a Kawakita-type bulk density meter manufactured by SEISHIN Enterprise Co., Ltd.). For measuring, the components of a toner are placed on a 48 mesh to which vibration is transmitted. Particles passed through the mesh are then housed in a 20 cm$^3$ container which is provided under the mesh. The total amount (g) of the particles is divided by the volume of the container which in this case is 20 cm$^3$ to obtain the loose apparent density.

The loose apparent density of the toner can be adjusted at a desired level by changing, for example, the added amount of wax to toner particles, the adding amount of external additives, or charge amount of toner. In the present invention, it is preferably adjusted by changing the added amount of hydrophobitic silica, added as the external additives, whose particles are in the range of 10 nm to 18 nm in diameter. The loose apparent density of the hydrophobitic silica is preferably in the range of 0.028 g/cm$^3$ to 0.033 g/cm$^3$. The loose apparent density of the hydrophobitic silica can be measured in the same manner as that of the toner described above.

-Binder Resin-

The binder resin used in the present invention is not particularly limited and can be selected from known resins in accordance with the purpose. Examples thereof include styrene resins (including single polymers and copolymers containing styrene or a styrene substituent) such as styrenes, poly-α-stilstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene acrylic acid ester copolymers, styrene-methacrylic acid ester copolymer and styrene-α-methyl chloroacrylate copolymer; polyester resins; epoxy resins; vinyl chloride resins; rosin-modified maleic resins; phenol resins; polyethylene resins; polypropylene resins; petroleum resins; polyurethane resins; ketone resins; ethylene-ethylacrylate copolymers; xylene resins and polyvinyl butyrate resins. Among these, polyester resins are particularly preferable in terms of the fixation characteristic.

Polyester resins obtained by using an inorganic tin (II) compound as a catalyst are preferable for the binder resin. The polyester resin can be formed by condensation polymerization of an alcohol component and acid component under the presence of inorganic tin (II) compound as a catalyst.

Examples of the acid component include aromatic dicarboxylic acids which include terephthalic acid, isophthalic acid, phthalic acid, diphenyl-P.P'-dicarboxylic acid, naphthalene-2.7-dicarboxylic acid, naphthalene-2.6-dicarboxylic acid, diphenylmethane-P.P'-dicarboxylic acid, benzophenone-4.4'-dicarboxylic acid,1 and 2-diphenoxyethane-P.P'-dicarboxylic acid; and other acids including maleic acids, fumaric acids, glutaric acid, cyclohexane dicarboxylic acid, succinic acid, malonic acid, adipic acid, mesaconic acid, itaconic acid, citraconic acid, sebacic acid, anhydrides of these acids and lower alkyl ester.

Examples of the acid component further include trimellitic acid, tri n-ethyl 1,2,4-tricarboxylate, tri n-butyl 1,2,4-tricarboxylate, tri n-hexyl 1,2,4-tricarboxylate, triisobutyl 1,2,4-benzenetricarboxylate, tri n-octyl 1,2,4-benzenetricarboxylate and tri 2-ethylhexyl 1,2,4-benzenetricarboxylate.

Examples of the alcohol component include polyoxypropylene(2,2)-2,2-bis(4-hydroxyphenyl)propane, polyoxyethylene(2)-2,2-bis(4-hydroxyphenyl)propane, polyoxypropylene(6)-2,2-bis(4-hydroxyphenyl)propane and polyoxypropylene(13)-2,2-bis(4-hydroxyphenyl)propane.

Examples of the alcohol component further include diols which include ethylene glycol, diethylene glycol, triethylene glycol, 1,2-propylene glycol, 1,3-propylene glycol, 1,4-butanediol, neopentylglycol and 1,4-butenediol; 1,4-bis(hydroxymethyl)cyclohexane; bisphenol A; and hydrogenated bisphenol A.

The above-stated polyester resin used in the present invention may contain, for example, an acid component (having an alkyl group or an alkenyl substituent) including maleic acids having a n-dodecenyl group, isododecenyl group, n-dodecyl group or isododecyl group, fumaric acids, glutaric acids, succinic acids, malonic acid and adipic acid; or an alcohol component including ethylene glycol, 1,3-propylenediol, tetramethylene glycol, 1,4-butylenediol and 1,5-pentyldiol.

Preferred examples of the above-stated inorganic tin (II) compound include those having a Sn—O binding and those having a Sn—X (where X represents one or more halogen atoms) binding. Those having the Sn—O binding are more preferable.

Examples of the compounds having the Sn—O binding include carboxylic tin oxides (II) (having a carboxylic acid group with 2 to 28 carbon atoms) including tin (II) octylate, oxalic oxide tin (II), diacetic tin oxide (II), dioctane tin oxide (II), dilauryl tin oxide (II), distearin tin oxide (II), dioleic tin oxide (II); dialkoxy tins (II) (having an alkoxy group with 2 to 28 carbon atoms) including dioctyloxy tin (II), dilauryloxy tin (II), distearyloxy tin (II) and dioleyloxy tin (II); tin oxides (II); and sulfuric tin oxides (II).

Examples of the compounds having the Sn—X (where X represents one or more halogen atoms) binding include halogenated tins (II) including tin chlorides (II) and tin bromides (II).

Among those, preferred compounds in terms of improving the charge initial rise property and catalyst property are fatty acid tin (II) expressed as $(R^6COO)_2Sn$ (where $R^6$ represents an alkyl group or alkynyl group with 5 to 19 carbon atoms); dialkoxy tin (II) expressed as $(R^7O)_2Sn$ (where $R^7$ represents an alkyl group or alkynyl group with 6 to 20 carbon atoms); and tin oxide (II) expressed as SnO. That fatty acid tin (II) expressed as $(R^6COO)_2Sn$ and tin oxides (II) are more preferable. Tin (II) octylate, dioctane tin oxide (II), distearin tin oxide (II) and tin oxides (II) are further preferable, and tin (II) octylate is most preferable.

A polyester resin containing the above-stated inorganic tin (II) compound, the above-stated alcohol component and the above-stated acid component can be formed by condensation polymerization of the alcohol component and a carboxylic acid component under the existence of the inorganic tin (II) compound as a catalyst in inert gas at a temperature in the range of 180° C. to 250° C.

The used amount of the inorganic tin (II) compound for the polymerization is preferably in the range of from 0.001 parts by mass to 5 parts by mass and more preferably in the range of from 0.05 parts by mass to 2 parts by mass per 100 parts by mass of the base monomer of the polyester resin.

Using 5% by mass to 30% by mass of a styrene-acrylate resin and a hybrid resin, respectively, as the binder resin enables to prevent the fixation characteristic of the resulted toner from degrading, form small toner particles and make the toner particle size distribution narrow.

The hybrid resin is preferably a monomer reactive with both polycondensed resins and addition polymerized resins on a chemical-bonding. Examples of the monomer reactive with both of the resins include fumaric acid, acrylic acid, methacrylic acid, maleic acid and dimethyl fumarate.

The used amount of the monomer reactive with both of the resins is preferably in the range of from 1 part by mass to 25 parts by mass and more preferably in the range of from 2 parts by mass to 10 parts by mass per 100 parts by mass of the base monomer of the addition polymerized resin. When the used amount is less than 1 part by mass, a colorant and/or charge control agent used with the toner may not be sufficiently dispersed therein, resulting in the occurrence of image fogging and the degradation in the image quality. When the used amount is larger than 25 parts by mass, it may result in the gelatinization of the resin.

Respective reactions of the hybrid resin with both of the resins do not need to be progressed at the same degree or completed at the same time. Each reaction can be performed at a different reaction temperature and time adjusted in accordance with respective properties of the resins.

The method of performing the condensation polymerization for forming polyester resin include the steps of mixing a mixture A into a mixture B contained in a reaction vessel by dropping the mixture B into the vessel, where the mixture A contains an addition polymerized-base monomer of a vinyl resin and a polymerization initiator and the mixture B contains a polycondensed-base monomer for the polyester resin and other components, polymerizing a vinyl resin by a radical reaction, and condensation-polymerizing a polyester resin by increasing the reaction temperature. By performing those steps for the respective resins in the reaction vessel, while performing the successive steps for one resin in parallel with the steps for the other, they can be effectively dispersed. In performing the polymerizations, the acid value of the hybrid resin is preferably in the range of from 15 mgKOH/g to 70 mgKOH/g, more preferably in the range of from 20 mgKOH/g to 50 mgKOH/g and further preferably in the range of from 20 mgKOH/g to 30 mgKOH/g. When the acid value is in the range of from 15 mgKOH/g to 70 mgKOH/g, the releasing agent can be sufficiently and effectively dispersed, and further, the resulted toner can be fixed at a low fixing temperature and has excellent weatherability. The improvement of the weatherability is considered to be attributed by lower fixing temperature which is achieved by a higher compatibility, increased by the higher acid value, between the resin and paper. When the acid value is lower than 15 mgKOH/g, the releasing agent contained and dispersed in the hybrid resin is easily released from the polyester resin. When it is higher than 70 mgKOH/g, the charged amount of the resulted toner is easily affected even by a small amount of water vapor in air and can become unstable.

The peak top molecular weight (Mp) of the toner, measured by the gel permeation chromatography, or GPC, is preferably in the range of 4,000 to 8,000. The ½ flow temperature of the toner, measured with a flow tester, is preferably in the range of 145° C. to 165° C. And further, the binder resin preferably contains the inorganic tin (II) compound as the catalyst. When the peak top molecular weight (Mp) is in the range of 4,000 to 8,000, it is possible to prevent the fixation characteristic of the toner from degrading and the collected toner particles from being pulverized by low molecular weight components.

When the ½ flow temperature of the toner is in the range of 145° C. to 165° C., toner particles placed on paper can keep their viscoelasticity while preventing them from being crushed and deformed, thus the granularity of formed images can be improved. When the inorganic tin (II) compound is contained in the binder resin as the catalyst, the electrostatic chargeability of the toner can be improved, reducing the number of toner particles needed to be collected from the surface of the photoconductor. By using tin octylate as the inorganic tin (II) compound, the electrostatic chargeability can be particularly improved. It is necessary that the wax contained in the toner particles be sufficiently dispersed therein in order to reduce the number of the toner particles to be re-used (collected). When the binder resin is a polyester resin, the wax may not be sufficiently dispersed in the toner particles. In this case, the wax can be sufficiently dispersed therein by adding a hybrid resin component (as the binder resin) containing both a vinyl polymerization unit and polyester unit which has an inorganic tin (II) compound as the catalyst. The wax can be most effectively dispersed in the particles when A and B, where A represents the content of the hybrid resin and B represents the content of the releasing agent, satisfy the following equation (1).

$$(1/2)\times B \leqq A \leqq 3 \qquad \text{Equation (1)}$$

When A and B satisfy the equation (1), the hybrid resin can effectively function as a releasing agent and a dispersant in the polyester resin, and thus the wax can be particularly sufficiently dispersed in the particles wherein the polyester resin serves as the binder resin. The inventors of the present invention found that the dispersibility of the releasing agent greatly affects the dispersibility of pigments because dispersed colorants are likely to adhere to the releasing agent. This is because, when raw materials for toner in the form of power are mixed, colorants including a carbon black, the pigment and/or masterbatch pigment are more likely to adhere to the releasing agent than the binder resin attracted by the high adhesion of the releasing agent. And further, the hydrophobic property of the vinyl polymerization unit of the hybrid resin can lower the moisture-absorption amount of the toner and achieve excellent weatherability and charging stability of the toner. The lower moisture-absorption amount can prevent the toner particles from absorbing moisture so that toner aggregation can be prevented. And that excellent dispersibility of the releasing agent can prevent the gloss formed of the toner from degrading, prevent toner aggregation occurred when the releasing agent is insufficiently dispersed, and enable the pigments to be sufficiently dispersed in a color toner so that it can provide images with high color reproducibility. When A is smaller than $\{(1/2)\times B\}$ in the equation (1), the content of the hybrid resin is insufficient so that the releasing agent and colorant will not be sufficiently dispersed, and thus the gloss of the images is easily degraded and toner aggregation can easily occur. On the other hand, when A is larger than 3B in the equation (1), the content of the hybrid resin is excessive so that the hybrid resin and the polyester resin serving as the binder resin are easily separated from each other and the content of the vinyl polymerization unit increases in the hybrid resin component, and thus the gloss of the images is easily degraded and formed images tend to have uneven brilliance. The fixing temperature of the toner may also be increased.

The peak top molecular weight (Mp) can be measured in a GPC chromatograph measurement apparatus by the successive steps of stabilizing a column at 40° C. in a heat chamber heated to the same temperature, flowing THF as a solvent to the columns at a flow rate of 1 ml per minute, and injecting 100 μl of THF sample solution. When the molecular weight is measured, the molecular weight distribution of the sample is calculated from the relation between logarithmic values of a standard curve based on several monodispersion polystyrene standard samples and counted numbers.

As the standard polystyrene samples, those having a molecular weight of $10^2$ to $10^7$ can be used. Examples thereof include those manufactured by Toyo Soda Kogyo and Showa Denko K.K. It is preferred that 10 or more standard polystyrene samples be used.

An RI (refraction index) detector can be used as a detector.

For the measurement, several columns are preferably used in combination. These can be selected from, for example, a group consisting of SHODEX GPC KF-801, 802, 803, 804, 805, 806, 807 and 800P (all manufactured by Showa Denko K.K.), or a group consisting of TSKgel G1000H(HXL), G2000H(HXL), G3000H(HXL), G4000H(HXL), G5000H (HXL), G6000H(HXL), G7000H(HXL) and TSKguardcolumn (all manufactured by Toyo Soda Kogyo).

In general, the peak top molecular weight (Mp) is measured in the GPC chromatograph from when chromatograph rises from the baseline to a molecular weight of 400 as the minimum molecular weight limitation.

The ½ flow temperature was measured on JIS K72101 standard with a flow tester (manufactured by SHIMADZU CORPORATION). In the measurement, a resin sample which is 1 $cm^3$ in volume is subjected to heating so that its temperature will rise by 6° C. per minute. Then, using a plunger, a pressure of 10 $kg/cm^2$ is applied to the sample to draw it through a nozzle which is 0.5 mm in diameter and 1 mm in length. An S-shaped dropped amount-temperature curve is plotted using the testing instrument during the sample is being drawn through the nozzle. The ½ flow temperature is a temperature at h/2 at which half of the resin is dropped, where "h" is the height of the obtained curve.

In general, a toner whose particles have a smaller diameter has better electrostatic chargeability, while its disadvantage is that the particles are easily scattered around members of an image developing apparatus. In order to balance the flowability and electrostatic chargeability of the toner, it preferably contains at least particulates of hydrophobic titanium oxide.

In addition, when the particulates of hydrophobic titanium oxide satisfy the following condition, it is possible to enhance the removability of the toner particles from surface of a photoconductor. That is, the ratio Ia/Ib, where "Ia" designates the maximum diffraction intensity and "Ib" designates the minimum diffraction intensity, is higher than 1.0 and smaller than 3.0 within the range, $2\theta$=20.0 deg. to 40.0 deg., measured by the x-ray diffraction described below. When the ratio Ia/Ib is smaller than 1.0, the particulates have no crystal structure. As a result, adding them to the toner particles cannot improve the electrostatic chargeability, and further makes the toner particles hard to be cleaned as they cause the reduction in the hardness of the toner particles and tend to adhere to the photoconductor because of their own viscosity. When the ratio Ia/Ib is larger than 3.0, the particulates have a strong crystal structure. As a result, the particulates abrade a cleaning blade, reducing its cleaning ability.

-X-Ray Diffraction-

Measurement instrument: MXP-18 (an X-ray diffractometer manufactured by MAC Science Co.)

Radiation source (target): Cu

Wave length: 1.5405 angstrom (radiation of CuKα1)

Tube voltage/tube current: 40.0 kV and 200 mA, respectively

Divergence slit: 1.0°

Receiving slit: 0.30 mm

Scatter slit: 1.0°

Scanning speed: 4.0 degree/min.

Hereinafter, the method of forming hydrophobic titanium oxide used in the present invention will be described. The method includes the following successive steps of (a) to (e):

(a) hydrolyzing a dispersed solution, the solution obtained by decomposing ilmenite with sulfuric acid, to generate metatitanic acid in slurry form.

(b) adjusting the pH level of the obtained metatitanic acid (c) sufficiently dispersing the metatitanic acid in a water-based medium so that whose particles are prevented from aggregating (d) reacting the metatitanic acid with a hydrophobizing agent by dropping the agent into the medium (e) filtering, drying or pulverizing the thus obtained reaction product to thereby obtain hydrophobic titanium oxide particulates.

Another method includes the following successive steps of (a') to (f'):

(a') feeding titanium tetraisopropoxide to glass wool little by little in nitrogen gas as a carrier gas with a chemical pump, where that glass wool is heated to about 200° C. so that the fed titanium tetraisopropoxide evaporates (b') thermolyzing the evaporated gas at about 300° C. within a fraction of time in a reaction vessel (c') rapidly cooling the thermolized product to obtain a reaction product (d) calcining the reaction product at about 300° C. for 2 hours (e') adjusting the ratio Ia/Ib so that the XD-Bragg angle ($2\theta$) is in the range of from 20.0 degree to 40.0 degree (f') hydrophobizing the product to thereby obtain hydrophobic titanium oxide particulates.

-Colorant-

As the colorant used in the present invention, all dyes and pigments publicly known can be used. For example, carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green, phthalocyanine green, anthraquinone green, titanium oxide, zinc flower, lithopone and mixtures thereof can be used. These may be used alone or in combination.

The color of the colorant is not particularly limited, and can be selected from black and other colors in accordance with the purpose. These may be used alone or in combination.

Examples of the black colorant include carbon blacks (C.I. pigment black 7) including furnace black, lampblack, acetylene black and channel black; metals including coppers, irons (C. I. pigment black 11) and titanium oxides; and organic pigments including aniline black (C. I. pigment black 1).

Examples of the colorant of the other colors include magenta pigments which include C. I. pigment reds 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, and 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C. I. pigment violets 19; and C. I. budreds 1, 2, 10, 13, 15, 23, 29 and 35.

Examples of the colorant of the other colors include cyan pigments which include C. I. pigment blues 2, 3, 15, 15:1, 15:2, 15:3, 15:4, 15:6, 16, 17, and 60; C. I. budblue 6; C. I. acid blue 45; copper phthalocyanine pigments substituted with 1 to 5 phthalimidomethyl groups at phthalocyanine structure; and greens 7 and 36.

Examples of the colorant of the other colors include yellow pigments which include C. I. pigment yellows 0-16, 1, 2, 3, 4, 5, 6, 7, 10, 11, 12, 13, 14, 15, 16, 17, 23, 55, 65, 73, 74, 83, 97, 110, 151, 154 and 180; C. I. bud yellows 1, 3, and 20; and orange 36.

The content of those colorants in the toner is not particularly limited and can be an appropriate level according to the purpose, while it is preferably in the range of from 1% by mass to 15% by mass and more preferably in the range of from 3% by mass to 10% by mass. When the content is less than 1% by mass, the degree of the color intensity of images formed with the toner will be degraded. And when it is more than 15% by mass, the colorants may not be sufficiently dispersed in the toner particles, resulting in the degradation in the degree of the color intensity and in the electrical property of the toner.

The colorant may be used as a masterbatch in which the colorant is combined with a resin. The binding resin used for the production of the master batch or kneaded with the master batch includes, in addition to the binder resins described above, polymers of styrene such as polystyrene, poly p-chlorostyrene, polyvinyl toluene and substituted products thereof; styrene based copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleate ester copolymers; polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic or alicyclic hydrocarbon resins, aromatic petroleum resins, chlorinated paraffin and paraffin waxes. These may be used alone or in combination.

-Charge Control Agent-

At least a charge control agent may be used in the toner of the present invention. Examples of the charge control agent include nigrosine dyes; quaternary ammonium salt; polymers containing an amino group; azo dyes containing a metal; complex compounds of salicylic acid; and phenolic compounds. These may be used alone or in combination.

-Releasing Agent-

The releasing agent used in the toner of the present invention is not particularly limited and can be selected from known ones in accordance with the purpose. Preferred examples thereof include free fatty acid-carnauba wax, montan wax and rice wax oxide. These may be used alone or in combination. By using at least one of those waxes, the above-stated hybrid resin can be effectively dispersed.

The carnauba wax is preferably in the form of microcrystal, and has an acid value of 5 mgKOH/g or lower, and whose particles preferably have a diameter of 1 μm or smaller when mixed into a toner binder.

The montan wax refers to, in general, a wax based on montan which is refined from mineral substances. Likewise to the carnauba wax, it is preferably in the form of microcrystal. The acid value thereof is preferably in the range of from 5 mgKOH/g to 14 mgKOH/g.

The rice wax oxide is obtained by oxidizing a rice bran wax with air. The acid value thereof is preferably in the range of from 10 mgKOH/g to 30 mgKOH/g.

As other releasing agents, at least one or a combination of two or more selected from known waxes can be used. Examples thereof include solid silicone waxes, higher fatty acid higher alcohols, montan ester waxes, and low molecular weight polypropylene wax.

The volume average particle diameter of the releasing agent before it is dispersed in the toner binder is preferably in the range of 10 μm to 800 μm.

-Other Components-

The other components are not particularly limited and can be selected in accordance with the purpose. Examples thereof include powder lubricants such as TEFLON (registered trademark) powder, zinc stearate powder, and polyvinylidene fluoride powder; abrasive powders such as cerium oxide powder, silicon carbide powder and strontium titanate powder; conductive enhancers such as carbon black powders, zinc oxide powder and tin oxide powder; and development ability enhancers such as a white particulate with a reversed polarity and a black particulate.

(Production Method for Toner)

The production method of the toner of the present invention is not particularly limited and can be selected from known methods in accordance with the purpose. Examples thereof include kneading-grinding, polymerization, solution suspension, and spray granulation. Among those, kneading-grinding is preferable for sufficiently dispersing colorants and its high productivity.

The kneading-grinding process includes the steps of, for example, mechanically mixing toner components consisting of at least a binder resin, a charge control agent and a pigment, melt-kneading the mixture, pulverizing the resulted product, and classifying the obtained particles. In mechanically mixing the components or melt-kneading the mixture, pulverized/classified particles that are not used for finished products may be mixed into the components/mixture to be reused.

The "particles that are not used for finished products", or by products, refer to particles that are obtained in the pulverizing/classifying and are too small or too large to be used for the finished products. When such particles are mixed into the components/mixture, the proportion of the particles to the toner components is preferably in the range of 1:99 to 50:50.

The method of mechanically mixing the toner components is not particularly limited. It in general can be done using a known mixer equipped with rotatable blades under the regular conditions.

After the completion of the mixing, the thus obtained mixture is placed in a kneader to be subjected to melt-kneading. As the kneader, any one of a mono-axis continuous kneader, bi-axis continuous kneader and batch type-roll mill can be used.

The mixture must be melt-kneaded under a carefully selected condition/environment so that the molecular chains of the binder resin are not cleaved. More specifically, the temperature for the melt-kneading should be determined in accordance with the softening temperature of the binder resin. Temperature excessively lower than the softening temperature causes a number of the chains to be cleaved, while excessively high temperature prevents the components from being dispersed.

After the completion of the melt-kneading, the resulted product is pulverized. In pulverizing the product, it is preferably at first roughly pulverized and then finely pulverized. Preferred methods of pulverizing the product include ramming the products/particles against a crushing plate by means of jet flow, and placing them in a narrow gap in between a rotating rotor and stator.

After the completion of the pulverizing, the thus obtained particles are classified in a stream by means of, for example, a centrifugal force to thereby obtain particles having a specified diameter to be used as the base for toner. Inorganic particulates, such as hydrophobitic silica powder, manufactured as described below may be added to and mixed with the obtained particles in order to improve the flowability, storage stability, development ability and transfer efficiency of the resulted toner.

For mixing a external additive, a general mixer for powder is used. The mixer preferably contains a jacket or the like so that its inside temperature can be controlled. For changing the magnitude of pressure continuously applied to the external additive in the mixer, the additive can be gradually added or added in several times. Other means, such as changing the rotation speed, rolling motion speed, mixing temperature, and mixing time of the mixer can also be used. Strong pressure followed by weak pressure can be applied at first to the additive, or it can be applied in the opposite way.

For mixing the additive, a V-shaped mixer, a locking mixer, a loedige mixer, a NAUTA mixer or a Henschel mixer can be used.

(Two-Component Developer)

The two-component developer of the invention contains the toner of the present invention and a carrier.

The carrier is not particularly limited and can be selected from known ones in accordance with the purpose. Examples thereof include magnetic-core material particles such as iron powders, ferrite powders, nickel powders and magnetite powders; magnetic particles covered with resin; and resin particles in which magnetic particle are dispersed. Of those minerals, those having a coating layer on the core material particle thereof are particularly preferable.

The resin of which the coating layer is formed is not particularly limited and can be selected in accordance with the purpose. Examples thereof include polyolefin resins such as polyethylene, polypropylene, chlorinated polyethylene, and chlorosulfonated polyethylene; polyvinyl or polyvinylidene resins such as polystyrene, acrylic (such as polymethylmethacrylate), polyacrylonitrile, polyvinyl acetate, polyvinyl alcohol, polyvinyl butyral, vinylchloride, polyvinyl carbazole, polyvinyl ether and polyvinyl ketone; fluorine resins such as polyvinyl-chloride acetate copolymer, polytetrafluoroethylene, polyvinyl fluoride, polyvinylidene fluoride and polychlorotrifluoroethylene; polyamides; polyesters; polyurethanes; polycarbonates; amino resins such as urea-formaldehyde resin; epoxy resins; and silicone resins. These may be used alone or in combination.

The average particle diameter of the carrier is preferably in the range of 35 μm to 80 μm for improving charging ability.

The two-component developer can be preferably used for forming images in variety of known electrophotography systems. It can be particularly preferably used in the image forming apparatus and image forming method, described below, of the present invention.

(Toner Container)

The toner container of the present invention contains the toner and/or the developer of the present invention.

The toner container is not particularly limited and may be appropriately selected from known ones in accordance with the purpose. Preferred examples thereof include those equipped with a lid.

The size, configuration, structure and material of the toner container are not particularly limited and can be appropriately determined in accordance with the purpose. For example, the toner container is preferably cylindrical, and particularly. It is particularly preferred to use a cylindrical toner container having spiral grooves on its inner periphery surface configured for conveying contained toner particles by its rotation to its outlet, and having a part of or the entire toner container which configured to function as a bellows.

The material of the toner container is not particularly limited and can be selected from appropriate materials. It is preferably selected from materials that enable to achieve high accuracy, the material including polyester resins, polyethylene resins, polypropylene resins, polystyrene resins, polyvinyl chlorides, polyacrylic resins, polycarbonate resins, ABS resin and polyacetal resins.

The toner container of the present invention can be easily stored and transported, is excellent in handling property, and can be preferably used when it is detachably attached to, for example, the process cartridge or the image forming apparatus of the present invention to supply toner.

(Process Cartridge)

The process cartridge of the present invention contains at least a latent electrostatic image bearing member (it may hereinafter be called electrophotographic photoconductor, electrophotographic photoconductor or image bearing member), a developing unit configured to develop the latent electrostatic image on the latent electrostatic image bearing member with the toner to form the visible image, and a cleaning unit configured to remove toner particles remaining on the surface of the latent electrostatic image bearing member after the development of the image, and further contains other appropriately selected units in accordance with the necessity.

The developing unit contains at least a developer container for storing at least the developer of the present invention, may also contain the toner of the present invention, and further contains at least a developer carrier for feeding the toner and/or developer therefrom. It may contain a layer thickness control member for controlling the thickness of carried toner layer.

The process cartridge of the present invention can be detachably attached to various image forming apparatuses for electrophotographic, and is preferably detachably attached to the below-mentioned image forming apparatus used in the present invention.

(Image Forming Method)

The image forming method of the present invention includes at least a charging step, an exposing step, a developing step, a fixing step, a cleaning step and a toner collecting step, preferably includes a step for collecting remaining toner particles to reuse them, and may further contain other appropriately selected steps such as a charge-eliminating step and a controlling step. The combination of the charging step and exposing step may be collectively called a latent electrostatic image forming step.

The image forming apparatus used in the present invention includes at least a charging unit, an exposing unit, a developing unit, a fixing unit, a cleaning unit and a toner collecting unit, preferably includes a unit configured for collecting remaining toner particles to be reused, and further includes other appropriately selected units such as a charge eliminating unit and a controlling unit. The combination of the exposing unit and charging unit may be collectively called a latent electrostatic image forming unit.

The image forming apparatus used in the image forming method of the present invention is not particularly limited, provided it forms electrophotographic images. It can be, for example, a copier or a printer.

An embodiment to implement an image forming apparatus used in the image forming method of the present invention will be described with reference to FIG. 1. The image forming apparatus, which is a digital copier, of FIG. 1 forms images by means of a known electrophotography and contains a photoconductor drum 1. A charger 2, an exposing unit 3, a developing unit 4, a transfer unit 5, a cleaning unit 6, a toner collecting unit 15 and a fixing unit 10 are provided around the photoconductor 1 from the upstream to the downstream of the rotation direction A.

The exposing unit 3 is configured for forming a latent electrostatic image on the photoconductor 1 from image signals which are produced by scanning an original or copy on a platen 7 with a reading unit 8.

The latent electrostatic image on the photoconductor 1 is developed into a toner image by the developing unit 4. Subsequently, the toner image is electrostatically transferred on transfer paper (which is fed by a paper feeding section 9) by the transfer unit 5. That transfer paper is then fed to a fixing unit 10 to fix the toner image thereon, and discharged from the apparatus.

After the transferring of the toner image, toner particles remaining and foreign substances on the photoconductor 1 are removed with the cleaning unit 6. The thus collected toner particles are fed to a toner hopper (not shown) through a toner collecting unit 15, mixed with other toner particles. These toner particles are then returned to a developer container (not shown) to be used in another image forming.

Figure 2:
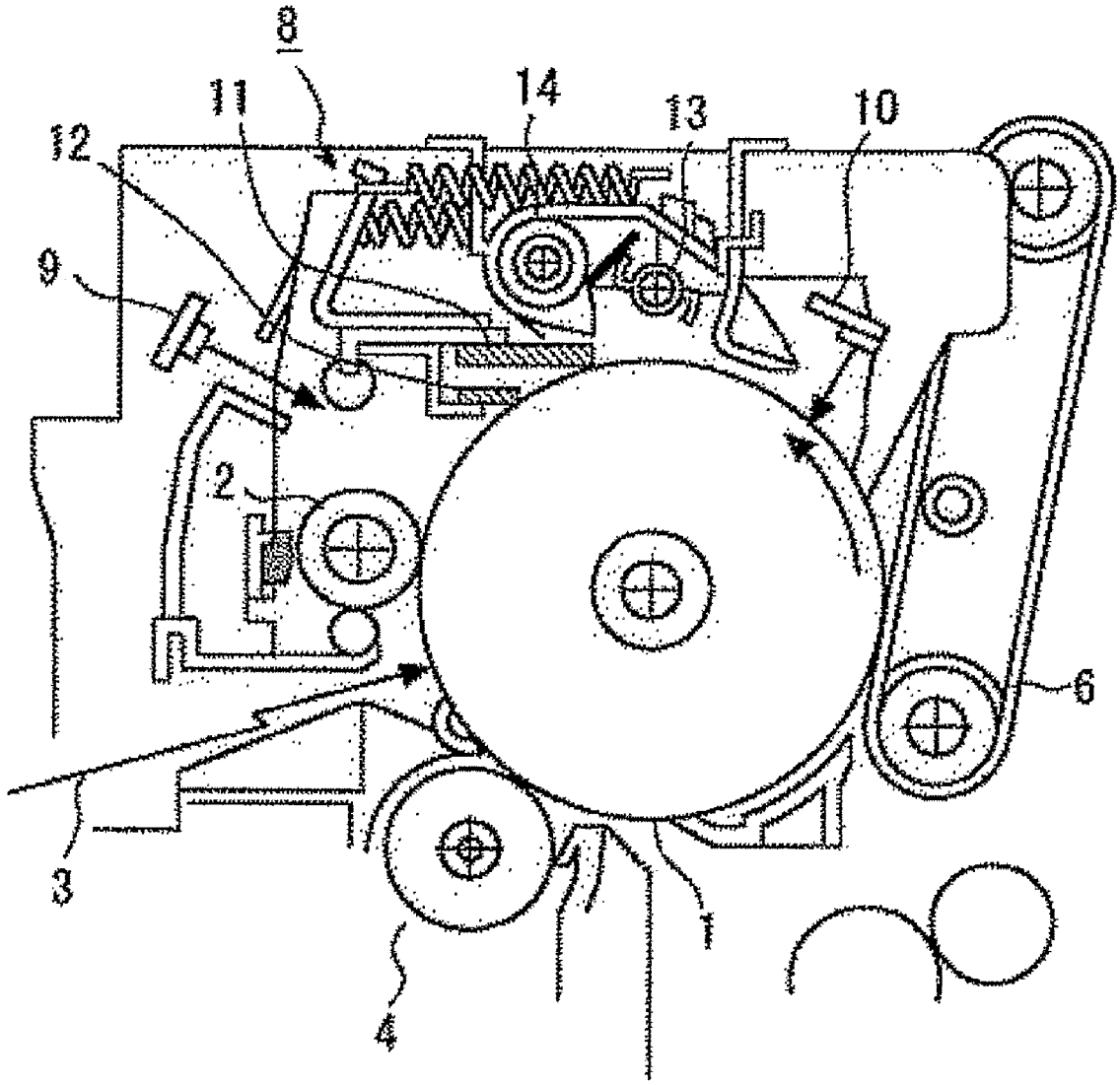
FIG. 2 is a schematic configuration diagram exemplarily showing the image forming apparatus of the present invention.

FIG. 2 schematically shows an embodiment of the image forming apparatus of the present invention. Around or in contact with a photoconductor 1, the following members are provided: a charger 2 for uniformly charging the surface of the photoconductor 1; an exposing unit 3 for forming a latent electrostatic image on the charged surface; a developing unit 4 for converting the latent electrostatic image into a toner image; a transfer unit 5 for transferring the toner image to recording paper; a cleaning unit 8 for cleaning the surface of the photoconductor 1 after the transferring of the toner image; and a charge-elimination unit 10 for discharging any remaining charge from the surface of the photoconductor 1.

Hereinafter, the cleaning unit 8 in FIG. 2 will be explained. The cleaning unit 8 contains a first cleaning blade 11 and second cleaning blade 12 which are located at the upstream and downstream, respectively, of the rotation direction of the photoconductor 1. It further contains a toner collecting blade 13, and a toner collecting coil 14 for transporting toner particles collected with the toner collecting blade 13. The collected toner particles are fed to the toner hopper through a toner collecting unit (not shown) and mixed with other toner particles therein. These toner particles are returned to the developer container to be used in another image forming.

The first cleaning blade 11 is made of, for example, metal, resin or rubber. It is preferably made of rubber selected from, for example, fluorine rubbers, silicon rubbers, butyl rubbers, butadiene rubbers, isoprene rubbers and polyurethane rubbers. Among those, the polyurethane rubbers are particularly preferable.

Figure 3:
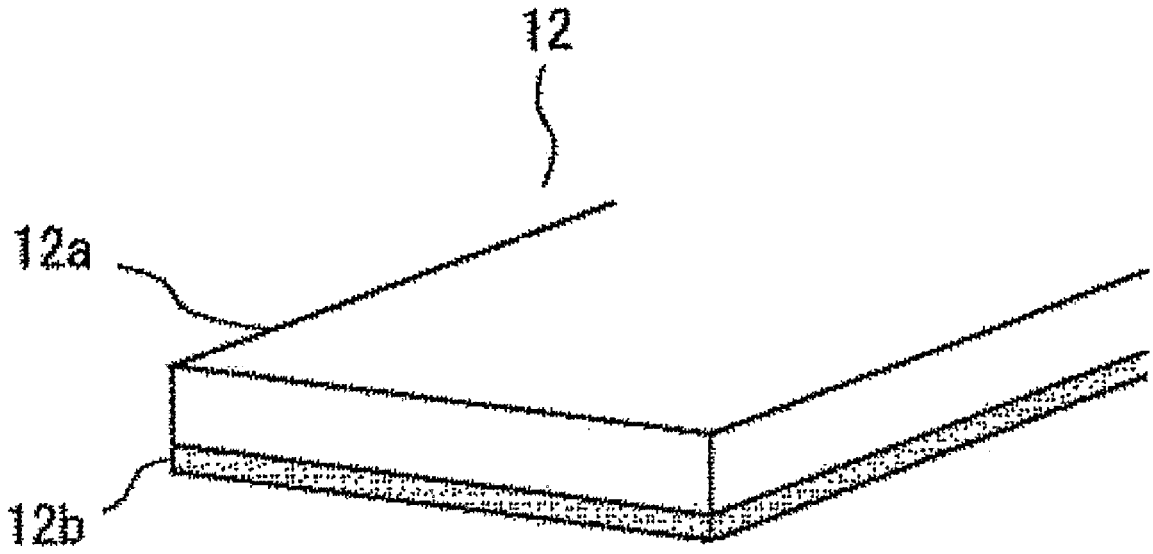
FIG. 3 is a schematic view exemplarily showing a second cleaning blade provided in the image forming apparatus of the present invention.

As shown in FIG. 3, the second cleaning blade 12 configured to scrape the surface of the photoconductor is composed of two layers, a base 12*a* and an abrasive particle-containing layer 12*b*.

The base 12*a* is made of, for example, rubber, a resin or metal. Likewise to the first cleaning blade, the rubbers are preferably used for the base 12*a*. And the polyurethane rubbers are particularly preferable. The abrasive particle-containing layer 12*b* is formed by dispersing abrasive particles in rubber.

When the base 12*a* is made of rubber, another rubber used for the abrasive particle-containing layer 12*b* preferably has a hardness of from 65° to 85°. When the hardness is lower than 65°, the abrasive particle-containing layer 12*b* may wear out quickly. And when the hardness is higher than 85°, the edge of the abrasive particle-containing layer 12*b* may easily be cracked.

Examples of the abrasive particle include nitrides such as silicon nitrides; calcareous substances such as aluminum silicate, magnesium silicate, mica, calcium silicate, calcium carbonate and plaster; carbides such as silicon carbide, boron carbide, tantalum carbide, titanium carbide, aluminium carbide, and zirconium carbide; and oxides such as cerium oxide, chrome oxide, titanium oxide, and aluminium oxide.

Among those, cerium oxide is preferable for its excellent abrasion effect.

The average particle diameter of the abrasive particles is preferably in the range of from 0.05 μm to 100 μm. When the average particle diameter is smaller than 0.05 μm, the particles are too small to be sufficiently dispersed in the rubber and to provide sufficient abrasion effect. When the average particle diameter is larger than 100 μm, the particles are so large that their abrasion effect is excessively strong, resulting in making scratches on the surface of the photoconductor 1.

The content of the abrasive particles in the abrasive particle-containing layer 12*b* is preferably in the range of from 0.5% by mass to 50% by mass. When the content is less than 0.5% by mass, the abrasive particles are sparsely dispersed in the abrasive particle-containing layer 12*b* so that it cannot provide sufficient abrasion effect. When the content is larger than 50% by mass, the amount of the abrasive particles is so excessive that the abrasive particles easily come off from the abrasive particle-containing layer 12*b*. That high content also increases the production cost of the abrasive particle-containing layer 12*b*.

In principle, the base 12*a* and abrasive particle-containing layer 12*b* can have any thickness, while the thickness of the abrasive particle-containing layer 12*b* is preferably within 0.5% to 50% of the thickness of the second cleaning blade 12. An abrasive particle-containing layer 12*b* having a thickness of thinner than 0.5% of the thickness of the second cleaning blade 12 is too thin to provide its abrasion effect over a long period of time. And when the abrasive particle-containing layer 12*b* has a thickness of wider than 50% of the thickness of the second cleaning blade 12, the second cleaning blade 12 will not have a sufficient elasticity so that the surface of the photoconductor 1 cannot be uniformly rubbed therewith. The second cleaning blade 12 is located and arranged such that its abrasive particle-containing layer 12*b* contacts the photoconductor 1.

The first cleaning blade 11 is provided mainly for removing remaining toner particles and paper dust from the surface of the photoconductor 1. The second cleaning blade 12 is provided for scratching substances (which are attached on the surface of the photoconductor 11 and mainly composed of inorganic particulates separated from toner particles) and filming substances off the photoconductor 1 with its abrasive particle-containing layer 12*b*. The second cleaning blade 12 is also for removing toner particles and paper dust that are not removed by the first cleaning blade 11 from the surface of the photoconductor 1. Because the abrasive particles are uniformly dispersed in the abrasive particle-containing layer 12*b* within the above-stated range, the particles enable the abrasive particle-containing layer 12*b* to uniformly scrape down a surface layer provided on surface of the photoconductor 1, thus it will not cause any problem on the surface.

And further, the dispersed abrasive particles can endure a long period of time compared with those provided on a surface of a cleaning blade and are easily taken off in a short period of time. Thus, the second cleaning blade 12 can be used as an effective means to clean the surface of a photoconductor over a long period of time.

The arrangement of the first cleaning blade 11 and the second cleaning blade 12 will be described below. In a preferred embodiment, when the first cleaning blade 11 and the base 12*a* are made of rubber, the rubber hardness of the base 12*a* is preferably higher than that of the first cleaning blade 11. In such a case, the higher hardness of the base 12*a* enables the cleaning blade 12 to apply pressure stronger than the first cleaning blade 11, enabling to remove attached substances and filming substances which the first cleaning blade 11 cannot remove from the surface of the photoconductor.

The first cleaning blade 11 and second cleaning blade 12 are preferably arranged in a counter manner, as shown in FIG. 2. When the first cleaning blade 11 is provided in the counter manner, it can effectively remove the remaining toner particles and paper dust from the surface of the photoconductor 1. And when the second cleaning blade 12 is provided in the counter manner, it can effectively remove the substances from the surface of the photoconductor 1 by impacts generated between the second cleaning blade 12 and the substances.

The contact angle of the second cleaning blade 12 to the surface of the photoconductor 1 is preferably in the range of from 5° to 25°. When the contact angle of the cleaning blade 12 is narrow than 5°, the bottom face of the blade contacts the photoconductor 1, causing creep deformation of the blade. In such a case, the abrasion effect will be ceased in a short period of time. And when the contact angle is wider than 25°, the blade may be twisted in a reverse direction when the photoconductor 1 reverses its rotation direction after the completion of an image forming process.

Linear pressure applied to the surface of the photoconductor 1 by the second cleaning blade 12 is preferably in the range of from 10 gf/cm to 60 gf/cm. When the contact pressure is lower than 10 gf/cm$^2$, the pressure is insufficient to scratch substances off the surface of the photoconductor 1, allowing some of which to remain on the surface. And when the contact pressure is stronger than 60 gf/cm$^2$, the layer which is provided on the photoconductor 1 will be excessively scraped down, shortening the operating life of the photoconductor 1.

The depth of the deformation amount (which is determined by the hardness of the second cleaning blade 12 and the contact pressure) where the second cleaning blade 12 contacts the layer on the photoconductor 1 is preferably in the range of 0.2 mm to 1.5 mm. When the second cleaning blade 12 is configured and arranged so that the indentation depth is in that range, the layer on the photoconductor 1 will not be excessively scraped down, and thus it can serve as an effective means for removing the substances from the surface.

Figure 4:
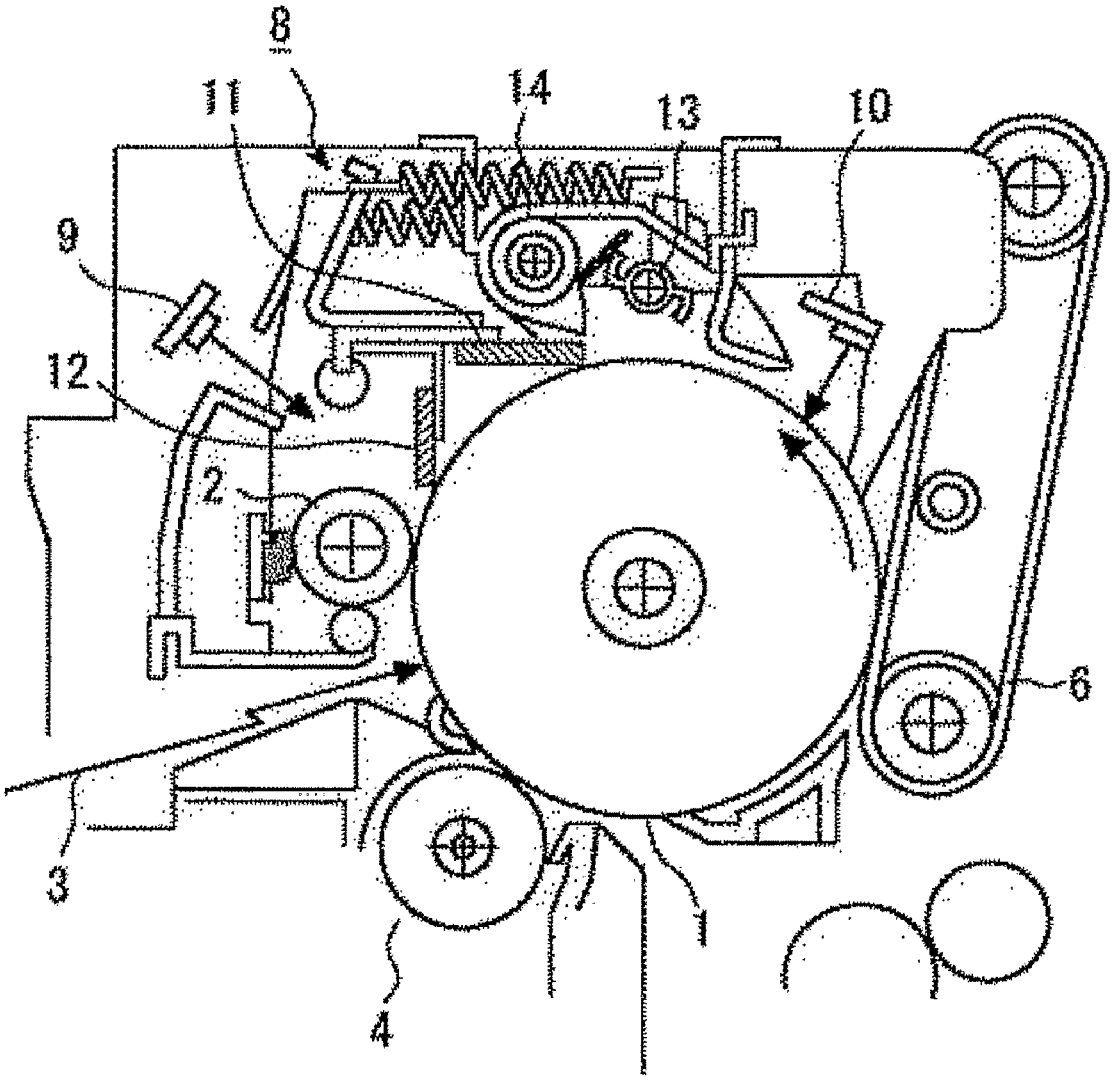
FIG. 4 is a schematic configuration diagram showing another example of the image forming apparatus of the present invention.

FIG. 4 schematically shows another embodiment of the image forming apparatus of the present invention. As shown in FIG. 4, the second cleaning blade 12 may be arranged in a trailing manner, whereas the first cleaning blade 11 is arranged in the counter manner. The first cleaning blade 11 is arranged in the counter manner for the same reason as mentioned above. It should be noted that when the second cleaning blade 12 is arranged in the trailing manner, its cleaning capability will be slightly degraded. The advantage of the trailing arrangement is that it is possible to prevent the second cleaning blade from being easily twisted in a reverse direction. It is easily twisted when arranged in the leading manner because few toner particles are on the surface of the photoconductor 1 to be removed by the second cleaning blade.

Likewise to the second cleaning blade 12 arranged in the counter manner, the contact pressure applied to the surface of the photoconductor 1 by the second cleaning blade 12 is preferably in the range of from 10 gf/cm$^2$ to 60 gf/cm$^2$. When the contact pressure is in that range, the second cleaning blade 12 can effectively clean the surface of the photoconductor 1.

In the cleaning unit shown in FIGS. 2 and 4, the second cleaning blade 12 can be arranged to always contact the photoconductor 1 or can be configured to contact it in accordance with necessity. In such a case, the second cleaning blade 12 will be moved with a control device such as a solenoidal or cam mechanism. When the second cleaning blade 12 is arranged in that manner so that it avoids always contacting the photoconductor 1, the scraped amount of the surface layer is reduced, enabling to extend the operation life of the photoconductor 1.

Figure 5:
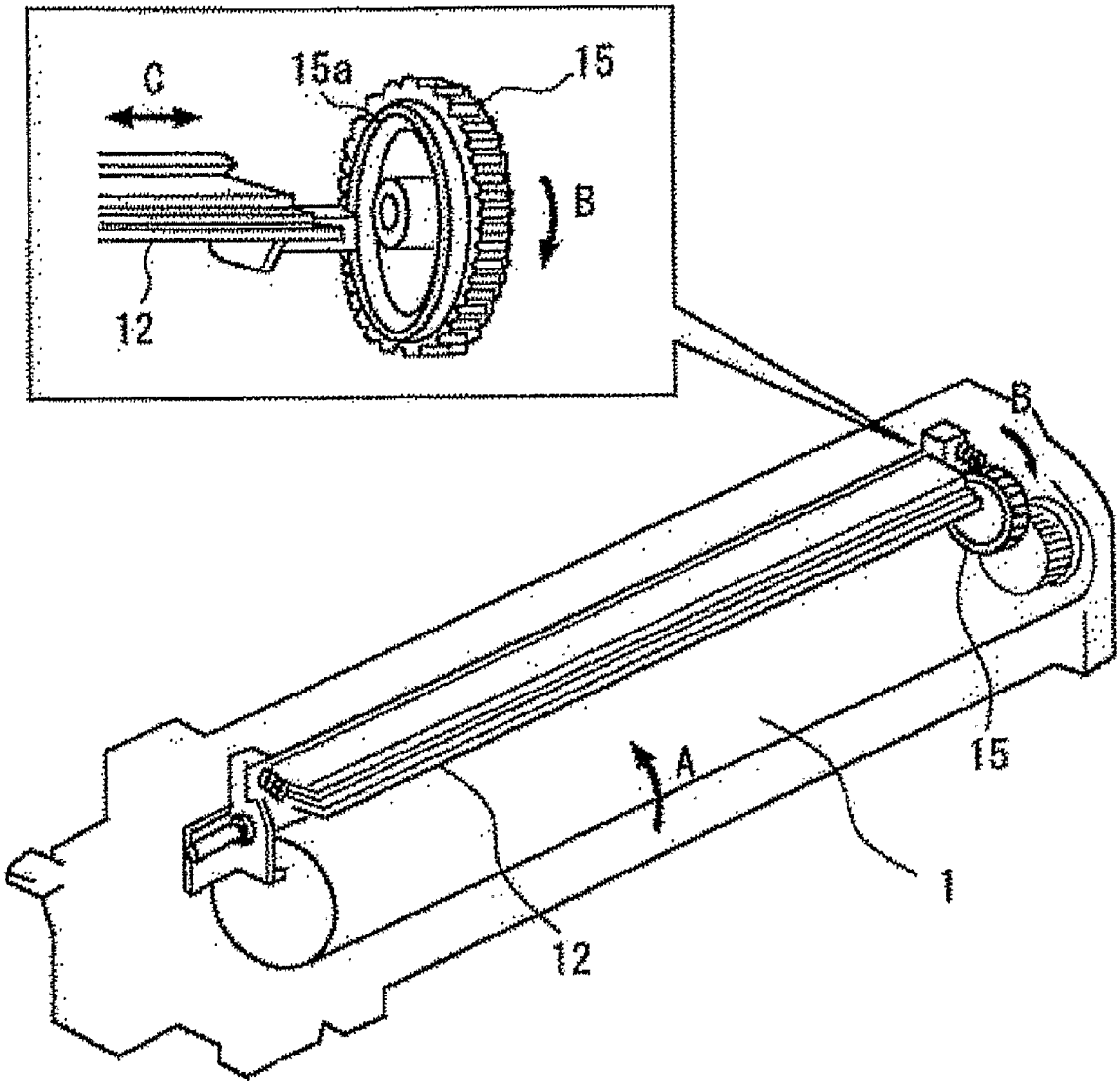
FIG. 5 is a schematic view showing a mechanism for applying lateral oscillation to a second cleaning blade in another embodiment of the image forming apparatus of the present invention.

It is preferred that the second cleaning blade 12 be further provided with a mechanism for applying lateral oscillation. FIG. 5 is a schematic view showing the mechanism for applying lateral oscillation with the second cleaning blade 12. The second cleaning blade 12 is retained by a pressure holder (not shown). A pair of bearings for supporting the pressure holder is attached thereto at its caulked edges. One side edge of the second cleaning blade 12 is pressed against a cam circumference 15*a* of a gear wheel 15 having an oscillation cam. When a photoconductor 1 rotates in the direction A, the gear wheel 15 rotates in the direction B to thereby apply oscillation to the second cleaning blade 12 in the lateral direction C. The mechanism for applying lateral oscillation enables the second cleaning blade 12 to uniformly scrape down the layer on the photoconductor 1 when the abrasive particles are not uniformly dispersed in the abrasive particle-containing layer 12*a*.

Although the first cleaning blade 11 contains no abrasive particles, it slightly scrapes down the layer on the photoconductor 1. Thus, it is preferred that the first cleaning blade 11 be also provided with the mechanism for applying lateral oscillation. Furthermore, the first and the second cleaning blades (11 and 12) are preferably given different oscillation timings so that the layer on the photoconductor 1 is further uniformly scraped down.

For applying the different oscillation timings, another cam circumference of a phase different from the cam circumference 15*a* may be provided therein so that the first and second cleaning blades (11 and 12) are given lateral oscillation from different cam circumferences.

The process cartridge of the present invention integrally contains the above-mentioned cleaning unit 8 and at least any one of the photoconductor, charging unit and developing unit. The process cartridge is configured to be detachably attached to the image forming apparatus. The process cartridge enables to keep the surface of the photoconductor at an excellent state over a long period of time and prevent image quality degradation, even with small toner particles.

The image forming apparatus with the cleaning unit 8 in the present invention is not limited to the embodiments of FIGS. 1, 2 and 4; it may be one having an intermediate transfer member to which toner images are transferred from a photoconductor or one having a plurality of photoconductors for different colors. In the present invention, the cleaning unit 8 can be particularly effective when the toner used in the developing unit 4 meets the following conditions: the number average particle diameter (D1) measured by the Coulter method is in the range of 3.5 μm to 6.5 μm; the variation coefficient of the number distribution of toner particles (where the variation coefficient is obtained by dividing the standard deviation of the number distribution of toner particles by the number average particle diameter) is in the range of 22.0 to 35.0; and, the content of toner particles having a diameter in the range of 4.00 μm to 8.00 μm is in the range of 40% by number to 59% by number. Small toner particles easily go through the gap between a surface of a photoconductor and a cleaning blade. And further, as the content of additives such as wax and/or inorganic particulates in toner particles tends to increase with reducing diameters of the toner particles, these additives are more easily detached from smaller toner particles, causing the contamination to other members.

In the present invention, however, the cleaning unit 8 enables to remove small toner particles and additives/substances of the toner particles from the surface of the photoconductor. In the cleaning unit 8, the first cleaning blade 11 removes the small toner particles and paper dust from the surface of the photoconductor 1; and the second cleaning blade 12 scratches attached substances mainly consists of a wax or inorganic particulates off the surface of the photoconductor 1 with the abrasive particle-containing layer 12*a*. The second cleaning blade 12 also removes toner particles and paper dust that are not removed by the first cleaning blade 11 from the surface of the photoconductor 1. The second cleaning blade 12 which is composed of the base 12*a* and the abrasive particle-containing layer 12*b* in which the abrasive particles are uniformly dispersed prevents its abrasive particles from being detached, enabling to provide its excellent cleaning capability over a long period of timer.

In conventional systems where toner particles are collected to be re-supplied, the small toner particles satisfying the above-stated conditions can be hardly removed from the surface of a photoconductor, are pulverized, mixed with additives so that the flowability of the toner degrades, and mixed with greater amount of paper dust with printing more sheets of paper so that reusing the toner particles becomes even harder. In the present invention, however, the cleaning unit having the first cleaning blade and the second cleaning blade (which has the base and abrasive particle-containing layer and configured to scrape the surface of the photoconductor) which are located at the upstream and downstream, respectively, of the rotation direction of the photoconductor 1 can provide excellent cleaning capability against such small toner particles.

As the toner of the present invention has excellent fixation characteristic, it can be suitably fixed on paper even with a fixing unit with a fixing roller whose wall thickness is 1.0 mm or thinner and where pressure applied to a unit area of the surface of one of the rollers (fixing or pressure roller) by the surface of the other roller is $1.5\times10^5$ Pa or lower, where the pressure is calculated by dividing load between the rollers by the contact area thereof. By using the fixing unit with such lower surface pressure, the toner can produce images with a higher granularity.

Figure 6:
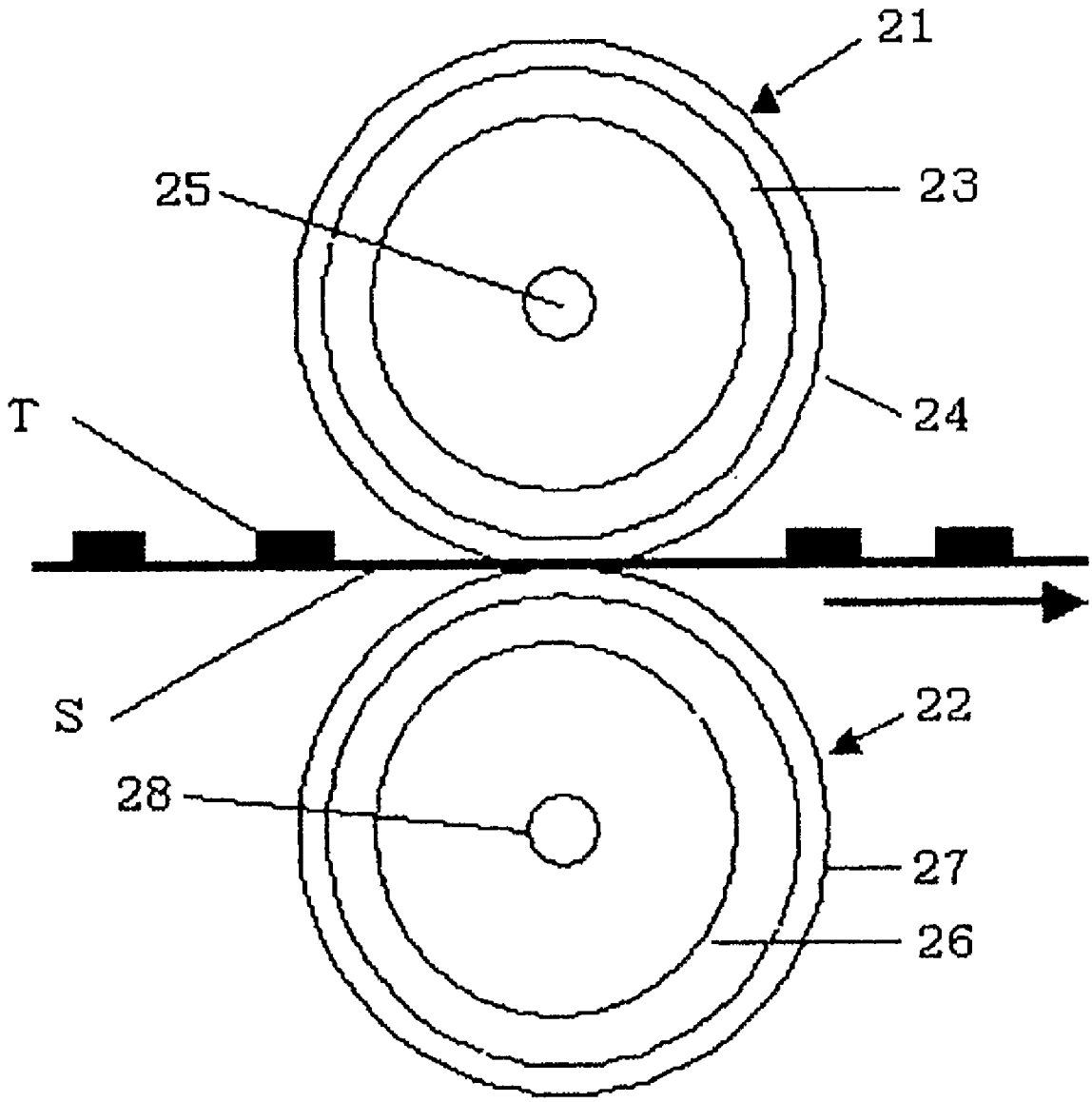
FIG. 6 is a schematic view exemplarily showing a fixing unit used in the image forming apparatus of the present invention.

An example of such fixing unit is shown in FIG. 6. In this fixing unit, a recording medium on which a toner image has been provided is fed in between the fixing roller (which apply heat to the toner image) and pressure roller so that the toner image is thermally fixed on the medium. In the fixing unit, the wall thickness of the fixing roller which touches the toner image is 1.0 mm or thinner and the surface pressure to the rollers is $1.5\times10^5$ Pa or lower. In FIG. 6, 21 is the fixing roller and 22 is the pressure roller. The fixing roller 21 is composed of a metal cylinder 23 and an offset preventing layer 24 covering the metal cylinder 23. The metal cylinder 23 is made of a high-heat conductive material such as aluminum, steal stainless-steel or brass. The offset preventing layer 24 is made of, for example, room temperature vulcanization (or RTV, which is in solid elastic state at room temperature), silicon rubber, tetrafluoroethylene-perfluoro alkyl vinylether (or PFA), or polytetrafluoroethylene (or PTFE). A heater 25 is installed inside the fixing roller 21. In general, a metal cylinder 26 constituting the pressure roller 22 is made of the same material as the metal cylinder 23. The surface of the metal cylinder 26 is covered with an offset preventing layer 27 which is made of, for example, PFA or peroxytrifluoroacetic acid (or PTFA). A heater 28 may be installed inside the pressure roller 22.

In FIG. 6, the fixing roller 21 rotates while it is given a force to contact the pressure roller 22 by a pair of springs provided at both ends thereof.

A recording medium (such as paper) is fed in between the fixing roller 21 and pressure roller 22 to fix a toner image T provided on the recording medium.

In a metal cylinder of the fixing roller used in the fixing unit in accordance with the present invention, its wall thickness is 1.0 mm or thinner, so that it can be heated to a desired temperature in a significantly short period of time.

Thickness of the metal cylinder is determined based on its strength and heat conductivity; in general, it is preferably in the range of 0.2 mm to 0.7 mm.

The load, or surface pressure, applied by the fixing roller to the pressure roller is preferably in the range of $1.5\times10^5$ Pa or lower. The surface pressure is determined by dividing the total magnitude of the pressures applied to both ends of the fixing roller by the springs by the contact area of the rollers.

To obtain the contact area of the rollers, a recoding medium is fed in between the fixing roller heated to its usual fixing temperature and pressure roller, and the feeding of the medium is halted at a point so that an area (A) of the medium is pressured therebetween for several tens of second. The surface condition of the area (A) changes greatly, and the contact area is acquired from the area (A). The recoding medium is selected from materials, such as an OHP sheet, whose surface condition changes greatly once heated.

Although a higher surface pressure is suitable for fixing the toner image, a large magnitude on the fixing roller composed of the metal cylinder whose wall thickness is 1.0 mm or thinner may result in its deformation. Thus, the pressure is preferably $1.5\times10^5$ Pa or lower and more preferably in the range of $0.5\times10^5$ Pa to $1.0\times10^5$ Pa.

Because of its small particle diameter and narrow particle size distribution, the toner of the present invention has an excellent thermal conductivity. Thus, toner images formed from the toner can be suitably fixed by the fixing unit with the fixing roller whose surface pressure is in the above-stated range. In that range, images with a higher granularity can be obtained.

EXAMPLES

The present invention will be further described by the following Examples, but they are not intended to limit the present invention. The terms "parts" and "%" used in Examples refers to "parts by mass" and "% by mass", respectively, unless otherwise mentioned.

Production Example 1

-Production of Titanium Oxide Powder-

Titanium oxide powders A, B, and C were obtained by performing the following steps for respective powders, the steps including: (a) little by little feeding titanium tetraisopropoxide as a base material to glass wool with a chemical pump, where the glass wool was under nitrogen gas (which was used as a carrier gas) environment, and heated to 200° C. so that the fed titanium tetraisopropoxide evaporates, (b) thermolyzing the evaporated gas at 320° C. in a reaction vessel (c) rapidly cooling the obtained thermolized article, and (d) calcinating the thus cooled article at the temperature and for the time in accordance with Table 1.

From the thus obtained powders A, B, and C, hydrophobic titanium oxide powders A, B, and C were obtained by performing the following steps for respective powders, the steps including: (a) sufficiently dispersing the powder in water (b) adding dropwise 30 parts by mass, based on the solid content, of hydrophobic methyl trimethoxy silane (per 100 parts by mass of the powder) to the thus obtained solution, while dispersing the powder and particles to avoid aggregation thereof (c) filtering and drying the resulted solution (d) heating the thus obtained article at 120° C. for 2 hours, and (e) pulverizing the heated article with a jet mill. The properties of the thus obtained hydrophobic titanium oxide powders A, B, and C are shown in Table 1.

TABLE 1

| | Calcinating Temperature (° C.) | Calcinating Time (min.) | Ia: cps | Ib: cps | Intensity ratio (Ia/Ib) |
|---|---|---|---|---|---|
| Titanium oxide powder A | 220 | 150 | 2516 | 2100 | 1.2 |
| Titanium oxide powder B | 300 | 80 | 2412 | 731 | 3.3 |
| Titanium oxide powder C | 250 | 120 | 1914 | 1044 | 1.8 |

Synthesis Example 1A

-Synthesis of Polyester Resin 1A-

In a four-necked 2 L glass flask equipped with a thermometer, a stainless steel-stirrer, a falling film condenser and a nitrogen feed tube, the following ingredients were placed: 740 g of polyoxypropylene(2,2)-2,2-bis(4-hydroxyphenyl) propane; 300 g of polyoxyethylene(2,2)-2,2-bis(4-hydroxyphenyl)propane; 466 g of dimethyl terephthalate; 80 g of isododecenyl succinic anhydride; 114 g of tri n-butyl 1,2,4-benzenetricarboxylate; and, 10 g of tin(II) octylate. The flask was then placed in an electric mantle heater to react the ingredients under a nitrogen gas environment at 210° C. The first half of the reaction was performed under normal pressure and the later half was performed under reduced pressure. Thus, polyester resin 1A was obtained. The non-dissolved proportion of the polyester resin 1A in tetrahydrofuran was 22%. The peak top molecular weight of the polyester resin 1A was 8,500.

Synthesis Example 2A

-Synthesis of Polyester Resin 2A-

In a four-necked 3 L glass flask equipped with a thermometer, a stainless steel-stirrer, a falling film condenser and a nitrogen feed tube, the following ingredients were placed: 551 g of polyoxypropylene(2,2)-2,2-bis(4-hydroxyphl)propane; 463 g of polyoxyethylene(2,2)-2,2-bis(4-hydroxyphenyl)propane; 191 g of fumaric acid; 169 g 1,2,4-benzenetricarboxylic acid; and, 12 g of tin (II) oxalic oxide. The flask was then placed in the electric mantle heater to react the ingredients under a nitrogen gas environment at 210° C. The first half of the reaction was performed under normal pressure and the later half was performed under reduced pressure. Thus, polyester resin 2A was obtained. The non-dissolved proportion of the polyester resin 2A in tetrahydrofuran was 18%. The peak top molecular weight of the polyester resin 2A was 6,000.

Synthesis Example 3A

-Synthesis of Hybrid Resin 1A-

In a dropping funnel, 410 g of styrene as a vinyl resin monomer, 90 g of 2-ethylhexyl acrylate, and 20 g of azobisisobutyronitrile as a polymerization initiator were placed. In a four-necked 5 L glass flask equipped with a thermometer, a stainless steel-stirrer, a falling film condenser and a nitrogen feed tube, the following ingredients were placed: 780 g of polyoxypropylene(2,2)-2,2-bis(4-hydroxyphl)propane; 24 g of fumaric acid; 76 g of isododecenyl succinic anhydride; 250 g of terephthalic acid; and 5 g of tin(II) octylate. The flask was then placed in the electric mantle heater to stir the ingredients at 135° C. under a nitrogen gas environment. The vinyl resin monomer and polymerization initiator were added dropwise from the dropping funnel in 1 hour. Subsequently, the resulted mixture was aged at 135° C. for 2 hours, and then its ingredients were reacted at 230° C. The reaction was continued until when a softening point in accordance with ASTM E28-67 standard reached 115° C. Thus, hybrid resin 1A was obtained. The non-dissolved proportion of the hybrid resin 1A in tetrahydrofuran was 0%. The peak top molecular weight of the hybrid resin 1A was 7,300.

Synthesis Example 4A

-Styrene-Acrylate Resin 1A-

In an autoclave reaction vessel equipped with a thermometer, an agitator and a nitrogen feed tube, 200 parts of xylene was placed, and the vessel was purged with nitrogen gas. The vessel (and its contents) was heated to 170° C. Subsequently, in the vessel, the following ingredients were added dropwise in 3 hours: a mixture of 719.2 parts of styrene, 271.6 parts of n-butyl acrylate, and 9.2 parts of γ-methacryloxypropyl trimethoxysilane; 1.5 parts of di-t-butyl peroxide as a polymerization initiator; and a mixture of 12 parts of divinylbenzene and 100 parts of xylene as a cross-linking agent. Subsequently, the resulted mixture in the vessel was aged at 170° C. for 1 hour to complete its polymerization. Then, the thus obtained products was desolventized under reduced pressure. Thus, styrene-acrylate resin 1A was obtained. The non-dissolved proportion of the styrene-acrylate resin 1A in tetrahydrofuran was 38%. The peak top molecular weight of the styrene-acrylate resin 1A was 15,600.

Synthesis Example 5A

-Synthesis of Polyester Resin 3A-

In a batch reaction vessel which was 7 $m^3$ in volume and equipped with a gas introduction tube, a condenser and an agitator, 2100 kg of polyoxypropylene(2.0)-2,2-bis(4-hydroxyphenyl)propane, 670 kg of fumaric acid and 20 kg of tin octylate were placed. They were heated to 240° C. and reacted under a normal pressure for 8 hours. Subsequently, they were further reacted under a reduced pressure of 3 kPa until a softening point reached the desired point. Then, the pressure in the vessel is returned to a normal level, and the heating and agitating were stopped to terminate the condensation polymerization. Cold water was flowed into water jackets in the vessel to cool down the thus obtained reaction products. After cooled down, the reaction product was pulverized. Thus, polyester resin 3A was obtained. The non-dissolved proportion of the polyester resin 3A in tetrahydrofuran was 0%. The peak top molecular weight of the polyester resin 3A was 3,500.

Synthesis Example 6A

-Synthesis of Hybrid Resin 2A-

Hybrid resin 2A was obtained in the same manner as in Synthesis Example 3 except that 7 g of dilauryloxy tin (II) was used instead of 5 g of tin(II) octylate. The reaction of the hybrid resin 2A was continued until when the softening point reached 108° C. Thus, hybrid resin 2A was obtained. The non-dissolved proportion of the hybrid resin 2A in tetrahydrofuran was 0%. The peak top molecular weight of the hybrid resin 2A was 6,800.

Synthesis Example 7A

Thus, styrene-acrylate resin 2A was obtained.

In the autoclave reaction vessel equipped with a thermometer, agitator and nitrogen feed tube, 300 parts of xylene was placed, and the vessel was purged with nitrogen gas. The vessel (and its contents) was heated to 170° C. In the vessel, a mixture of the following ingredients were added dropwise in 3 hours: 719.2 parts of styrene; 271.6 parts of n-butyl acrylate; 9.2 parts of γ-methacryloxypropyl trimethoxysilane; and, 1.5 parts of di-t-butyl peroxide as a polymerization initiator. Subsequently, the resulted mixture in the vessel was aged at 170° C. for 1 hour to complete its polymerization. Then, the thus obtained products was desolventized under reduced pressure. Thus, styrene-acrylate resin 2A was obtained. The non-dissolved proportion of the styrene-acrylate resin 2A in tetrahydrofuran was 0%. The peak top molecular weight of the styrene-acrylate resin 2A was 3,400.

Example 1

20 parts of polyester resin 1A 5 parts of hybrid resin 1A 50 parts of polyester resin 3A 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.) at 150° C. The thus obtained kneaded product was pulverized with IDS-2 (a pulverizer equipped with a crushing plate, manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles 1 were obtained. Using a sample mill, 2.0 parts of colloidal silica (H-2000, manufactured by Clariant (Japan) K. K.) per 100 parts of the toner base particles 1 was added thereto, and they were mixed together. Aggregated particles were removed from the mixture with a ultrasonic mesh, and thereby toner 1 was obtained.

For the toner 1, the particle size distribution was analyzed as a percentage of channel content (% by number) with a Coulter Multisizer II. Obtained results, including particle size distribution, the variation coefficient A of the number distribution (where the variation coefficient A is obtained by dividing the standard deviation of the number distribution by the number average particle diameter), the variation coefficient B of the volume distribution (where the variation coefficient B is obtained by dividing the standard deviation of the volume distribution by the volume average particle diameter), ½ flow temperature, peak top molecular weight and loose apparent density, are shown in Table 2.

-Production of Developer 1-

The toner 1 and a silicone-coated carrier having a volume average particle diameter of 50 μm (where the added content of the coat carrier was 5% of the total mass of the toner 1) were mixed together. Thus, developer 1 was obtained.

The toner components in Examples 2 to 14 and Comparative Examples 1 to 4 will be shown below. Using the same kneader/pulverizer and other apparatuses as in Example 1, the below mentioned toner components for Examples 2 to 14 and Comparative Examples 1 to 4 were kneaded. The resulting kneaded products were pulverized for forming toner base particles 2 to 14 and of Comparative Examples 1 to 4, and then they were classified. The conditions in pulverizing and classifying were adjusted in each Example and Comparative Example so that particles having the desired diameter shown in Table 2 were obtained. To respective toner base particles 2 to 14, the additives that will be mentioned in the corresponding section were provided, and thereby toners 2 to 14 were obtained.

With each of the toners 2 to 14, the silicone-coated carrier (where the added content of the coat carrier was 5% of the total mass of the each toner) having an average volume diameter of 50 μm was mixed to obtain developers 2 to 14.

The resulting properties of toners 2 to 14, the results including particle size distribution, the variation coefficient A of the number distribution (where the variation coefficient A is obtained by dividing the standard deviation of the number distribution by the number average particle diameter), the variation coefficient B of the volume distribution (where the variation coefficient B is obtained by dividing the standard deviation of the volume distribution by the volume average particle diameter), 2/14 flow temperature, peak top molecular weight and loose apparent density, are shown in Tables 2 and 3.

Example 2

The toner components for toner base particles 2 were the same as for toner base particles 1. The conditions in pulverizing and classifying were changed from Example 1.

-Toner Component- 100 parts of toner base particles 2

1.0 part of H-2000 (a colloidal silica, manufactured by Clariant (Japan) K. K.)

0.5 parts of titanium oxide powder C

Example 3

The toner components for toner base particles 3 were the same as for toner base particles 1. The conditions in pulverizing and classifying were changed from Example 1.

-Toner Component- 100 parts of toner base particles 3

1.5 parts of H-2000 (a colloidal silica, manufactured by Clariant (Japan) K. K.)

Example 4

-Toner Components for Toner Base Particles 4-

15 parts of polyester resin 1A 30 parts of polyester resin 3A 30 parts of hybrid resin 1A 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

-Toner Component- 100 parts of toner base particles 4

1.5 parts of H-2000 (a colloidal silica, manufactured by Clariant (Japan) K. K.)

0.5 parts of H-2150VP (a colloidal silica, manufactured by Clariant (Japan) K. K.)

Example 5

-Toner Components for Toner Base Particles 5-

25 parts of polyester resin 1A 30 parts of polyester resin 3A 20 parts of hybrid resin 2A 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

-Toner Component- 100 parts of toner base particles 5

1.5 parts of H-2000 (a colloidal silica, manufactured by Clariant (Japan) K. K.)

0.8 parts of titanium oxide powder A

Example 6

-Toner Components for Toner Base Particles 6-

21 parts of polyester resin 1A 4 parts of hybrid resin 1A 50 parts of polyester resin 3A 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

-Toner Component- 100 parts of toner base particles 6

0.5 parts of OX50 (a hydrophobitic silica, manufactured by Clariant (Japan) K. K.)

0.4 parts of titanium oxide powder C

Examples 7 and 8

-Toner Components for Toner Base Particles 7 and 8-

55 parts of polyester resin 2A 25 parts of hybrid resin 1A 3 parts of PB34 (a chromium complex azo, manufactured by Orient Chemical Industries, LTD.)

7 parts of WEP-1 (an ester wax, manufactured by NOF CORPORATION)

10 parts of REGAL 330R (a carbon black, manufactured by CABOT Corporation)

-Toner Component- 100 parts of toner base particles 7/8

1.2 parts of H-2000 (a colloidal silica, manufactured by Clariant (Japan) K. K.)

0.7 parts of titanium oxide powder B

Examples 9 to 11

-Toner Components for Toner Base Particles 9 to 11-

60 parts of polyester resin 1A 20 parts of styrene-acrylate resin 2A 7 parts of carnauba wax manufactured by TOAGOSEI CO., LTD.

3 parts of X-11 (a zirconium complex based on salicylic acid derivatives, manufactured by Orient Chemical Industries, LTD.)

10 parts of REGAL 330R (a carbon black, manufactured by CABOT Corporation)

-Toner Component- 100 parts of toner base particles 9/10/11

0.8 parts of R972 (a colloidal silica, manufactured by Clariant (Japan) K. K.)

Example 12

-Toner Components for Toner Base Particles 12-

40 parts of styrene-acrylate resin 1A 40 parts of styrene-acrylate resin 2A 5 parts of Viscol 660P (a polypropylene wax, manufactured by SANYO Chemical Industries)

5 parts of E-84 (a zinc complex based on salicylic acid derivatives, manufactured by Orient Chemical Industries, LTD.)

10 parts of REGAL 330R (a carbon black, manufactured by CABOT Corporation)

-Toner Component- 100 parts of toner base particles 12

1.5 parts of H-30 (a colloidal silica, manufactured by Clariant (Japan) K. K.)

Example 13

-Toner Components for Toner Base Particles 13-

70 parts of polyester resin 1A 30 parts of polyester resin 3A parts of X-11 (a zirconium complex based on salicylic acid derivatives, manufactured by Orient Chemical Industries, LTD.)

5 parts of WEP-1 (an ester wax, manufactured by NOF CORPORATION)

10 parts of REGAL 330R (a carbon black, manufactured by CABOT Corporation)

-Toner Component- 100 parts of toner base particles 13

1.5 parts of H-30 (a colloidal silica, manufactured by Clariant (Japan) K. K.)

0.5 parts of titanium oxide powder C

Example 14

100 parts of toner base particles 1

2.5 parts of H-2000 (a colloidal silica, manufactured by Clariant (Japan) K. K.)

0.3 parts of titanium oxide powder C

Comparative Example 1

Toner Components for Toner Base Particles of Comparative Example 1

55 parts of polyester resin 1A 20 parts of hybrid resin 1A 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

-Toner Component- 100 parts of toner base particles of Comparative Example 1

1.0 parts of H-2000 (a colloidal silica, manufactured by Clariant (Japan) K. K.)

Comparative Example 2

Toner Components for Toner Base Particles of Comparative Example 2

70 parts of polyester resin 2A 5 parts of styrene-acrylate resin 2A 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

-Toner Component- 100 parts of toner base particles of Comparative Example 2

1.0 parts of H2000 (a hydrophobitic silica, manufactured by Clariant (Japan) K. K.)

Comparative Examples 3 and 4

100 parts of toner base particles of Comparative Example 3/4

1.5 parts of H-2000 (a colloidal silica, manufactured by Clariant (Japan) K. K.)

0.3 parts of titanium oxide powder C

<Evaluation>

The weight average particle diameter (Dv) and number average particle diameter (Dn) were obtained from the following equations. The results are shown in Tables 2 and 3.

$$\text{Weight average particle diameter } (Dv) = \frac{\Sigma nD}{\Sigma n}$$

$$\text{Number average particle diamater } (Dn) = \frac{\Sigma nD^4}{\Sigma nD^3}$$

$$D = 2^{\frac{CH+0.5}{3}}$$

Where "n" represents the number of measured particles, and CH represents each channel.

All the toners, toners of Examples 1 to 14 and Comparative Examples 1 to 4, were used in Imagio NEO 450 (an image forming apparatus where toner particles are collected to be re-supplied, manufactured by Ricoh Company, Ltd.) to evaluate their properties.

Imagio NEO 450 contains the first cleaning blade 11 as shown in FIG. 2 and is devoid of a second cleaning blade 12.

In Example 15, Imagio NEO 450 to which the second cleaning blade 12 was attached as shown in FIG. 2 was used to measure the properties of the toner of Example 1.

Also in Example 16, Imagio NEO 450 to which the second cleaning blade 12 was attached as shown in FIG. 2 was used to measure the properties of the toner of Example 3.

<Image Forming>

The following evaluations were conducted after 100,000 sheets of paper were printed with Imagio NEO 450 under room temperature/humidity, 25° C./60% relative humidity. The results are shown in Tables 2 and 3.

<Sharpness>

Figure 7:
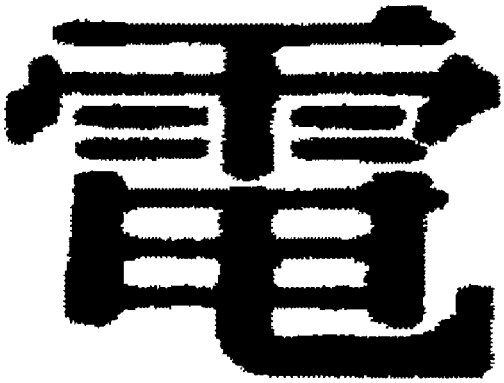
FIG. 7 shows grading criteria used in Examples for evaluating the sharpness of characters.
Figure 7:
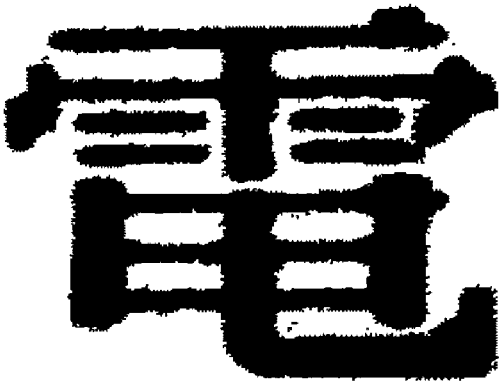
Figure 7:
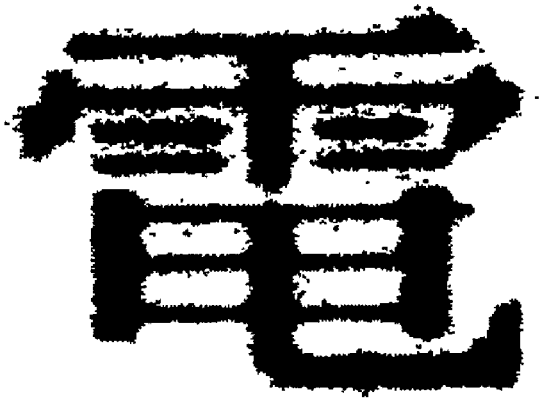

A Chinese character, 「電」 was formed to the full extent of a 2 mm by 2 mm area on paper. The character was magnified by 30 times to evaluate its sharpness using the grading criteria shown in FIG. 7. Rank 2 (4) sharpness is in the middle between 1 and 3 (3 and 5). The results are shown in Tables 2 and 3.

<Image Density>

A solid black circle having a diameter of 3 cm was formed on paper. The image density was found by measuring the average density of ten different spots in the circle with a Macbeth densitometer. The results are shown in Tables 2 and 3.

<Non-Uniformity in Image Density>

The non-uniformity in image density was found by calculating the difference between the maximum and minimum densities among the densities of the ten different spots in the solid black circle. The results are shown in Tables 2 and 3.

<Image Fogging>

The occurrences of image fogging were rated using the following evaluation criteria: The results are shown in Tables 2 and 3.

A: Image fogging was not recognized

B: Image fogging was recognized to some extent/acceptable in practical use

C: Image fogging was recognized/unacceptable in practical use

<Removability of Toner Particles>

The removability of the toner particles were rated from the appearance of vertical blank lines in images, using the following criteria:

A: Vertical blank lines were not recognized

B: Some vertical blank lines were recognized/acceptable in practical use

C: Many vertical blank lines were recognized/unacceptable in practical use The results are shown in Tables 2 and 3.

<Fixation Characteristic of Toner Particles>

For the evaluation of the fixation characteristic of the toner particles, images were formed with Imagio 420 (an image forming apparatus, manufactured by Ricoh Company, Ltd.) with each of the toners at different fixing temperatures.

A piece of mending tape available from 3M Company was provided for and affixed to the respective images (which had a toner deposition amount of 0.85±0.05 mg/cm$^2$) by applying pressure using a weight weighing 2 kg. The pieces of tape were slowly peeled off. The image densities of where the pieces of tape were affixed were measured before the affixing and after the removing of them. The image densities were measured with the Macbeth densitometer. The fixation characteristic of particles of each toner was evaluated on the following equation for the Proportion of Remaining Toner Particles (%).

$$\text{Proportion of Remaining Toner Particles (\%)} = \frac{\text{Image density after the removing of tape}}{\text{Image density density before the affixing of tape}} \times 100$$

The lowest fixing temperature in Tables 2 and 3 is a level at which the Proportion of Remaining Toner Particles (%) is 80% or lower. The lowest fixing temperature was obtained by decreasing the fixing temperature by degrees in the image forming apparatus.

<Hot Offset Temperature> The fixing temperature from which the hot offset of the fixed toner occurs was measured in the same manner as in examining the lowest fixing temperature. The occurrence of the hot offset was visually observed. The results are shown in Tables 2 and 3.

<Feed of Pulverized Particles>

Using IDS-2 (a pulverizer, manufactured by Nippon Pneumatic Mfg. Co., Ltd.) equipped with a flat crushing plate which is used in toner production processes, each toner was pulverized under the following conditions: air pressure: 6.0 kg/cm$^2$/louver height: 20 mm/adjust ring: 60 mm/distant ring: 20 mm/clearance: 80 mm/louver intervals: 2 mm/short tube: 20 mm/UR upper valve opening: 40/cyclone upper opening: 90. Of resulting pulverized particles of each toner, the feed of pulverized particles having a diameter in the range of from 5.0 μm to 5.3 μm based on weight average particle diameter was measured. The results are shown in Tables 2 and 3.

TABLE 2

| Channel | Particle size distribution | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| 1 | 1.26-1.59 (% by number) | 0.0 | 0.0 | 0.0 | 0.0 | 0.0 | 0.0 | 0.0 | 0.0 | 0.0 | 0.0 |
| 2 | 1.59-2.00 (% by number) | 0.0 | 0.0 | 0.0 | 0.0 | 0.0 | 0.0 | 0.0 | 0.0 | 0.0 | 0.0 |
| 3 | 2.00-2.52 (% by number) | 14.2 | 8.8 | 8.1 | 0.8 | 0.8 | 4.7 | 4.8 | 1.0 | 1.2 | 0.0 |
| 4 | 2.52-3.17 (% by number) | 15.4 | 18.2 | 20.8 | 9.5 | 9.7 | 12.0 | 10.7 | 1.5 | 4.8 | 6.8 |
| 5 | 3.17-4.00 (% by number) | 30.2 | 25.7 | 29.2 | 30.4 | 30.8 | 27.4 | 30.5 | 38.4 | 10.1 | 13.1 |
| 6 | 4.00-5.04 (% by number) | 32.6 | 27.2 | 36.6 | 44.4 | 45.0 | 34.9 | 29.7 | 25.2 | 13.0 | 15.2 |
| 7 | 5.04-6.35 (% by number) | 7.2 | 16.4 | 5.3 | 12.8 | 12.9 | 18.6 | 19.0 | 21.2 | 19.8 | 18.9 |
| 8 | 6.35-8.00 (% by number) | 0.4 | 3.5 | 0.0 | 1.8 | 0.8 | 2.3 | 4.3 | 11.2 | 25.3 | 24.2 |
| 9 | 8.00-10.10 (% by number) | 0.0 | 0.0 | 0.0 | 0.4 | 0.0 | 0.1 | 1.1 | 1.2 | 20.5 | 18.8 |
| 10 | 10.10-12.70 (% by number) | 0.0 | 0.0 | 0.0 | 0.0 | 0.0 | 0.0 | 0.0 | 0.2 | 5.1 | 3.0 |
| 11 | 12.70-16.00 (% by number) | 0.0 | 0.0 | 0.0 | 0.0 | 0.0 | 0.0 | 0.0 | 0.0 | 0.2 | 0.0 |
| 12 | 16.00-20.20 (% by number) | 0.0 | 0.0 | 0.0 | 0.0 | 0.0 | 0.0 | 0.0 | 0.0 | 0.0 | 0.0 |
| 13 | 20.20-25.40 (% by number) | 0.0 | 0.0 | 0.0 | 0.0 | 0.0 | 0.0 | 0.0 | 0.0 | 0.0 | 0.0 |
| 14 | 25.40-32.00 (% by number) | 0.0 | 0.0 | 0.0 | 0.0 | 0.0 | 0.0 | 0.0 | 0.0 | 0.0 | 0.0 |
| 15 | 32.00-40.30 (% by number) | 0.0 | 0.0 | 0.0 | 0.0 | 0.0 | 0.0 | 0.0 | 0.0 | 0.0 | 0.0 |
| 16 | 40.30-50.80 (% by number) | 0.0 | 0.0 | 0.0 | 0.0 | 0.0 | 0.0 | 0.0 | 0.0 | 0.0 | 0.0 |
| Number average particle diamter (D1) (μm) | | 3.7 | 4.1 | 3.8 | 4.2 | 4.2 | 4.2 | 4.3 | 4.7 | 6.5 | 6.2 |
| Variation coefficient A of the number distribution | | 26.1 | 30.5 | 23.3 | 22.0 | 22.4 | 25.6 | 28.9 | 28.4 | 34.7 | 34.9 |

TABLE 2-continued

| Channel | Particle size distribution | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| Variation coefficient B of the mass distribution | | 21.4 | 32.4 | 18.7 | 19.4 | 19.4 | 26.3 | 29.7 | 27.9 | 24.3 | 23.6 |
| Proportion of 4.00 to 8.00 μm particles (% by number) | | 40.2 | 47.0 | 41.9 | 59.0 | 58.8 | 55.8 | 52.9 | 57.7 | 58.1 | 58.4 |
| Weight average particle diameter (D4) (μm) | | 4.4 | 5.2 | 4.3 | 4.9 | 4.7 | 5.0 | 5.5 | 6.0 | 8.5 | 8.1 |
| D4/D1 | | 1.19 | 1.28 | 1.15 | 1.16 | 1.12 | 1.20 | 1.28 | 1.27 | 1.31 | 1.32 |
| Loose apparent density (LAD) (g/cm$^3$) | | 0.39 | 0.36 | 0.35 | 0.36 | 0.35 | 0.32 | 0.34 | 0.33 | 0.31 | 0.30 |
| Peak molecular weight (Mp) | | 4000 | 4000 | 4000 | 5200 | 5800 | 4000 | 6800 | 6800 | 8200 | 8200 |
| ½ flow temperature (° C.) | | 148 | 148 | 148 | 152 | 158 | 148 | 162 | 162 | 165 | 165 |
| Imgage density | | 1.50 | 1.52 | 1.45 | 1.46 | 1.42 | 1.48 | 1.47 | 1.45 | 1.40 | 1.40 |
| Non-uniformity in image density | | 0.02 | 0.01 | 0.03 | 0.03 | 0.06 | 0.05 | 0.04 | 0.04 | 0.08 | 0.05 |
| Sharpness | | 5 | 5 | 5 | 5 | 5 | 5 | 4-5 | 4-5 | 4 | 4 |
| Image fogging | | A | A | A | A | A-B | A-B | B | B | B | B |
| Removability of toner particles | | B | A | B | B | A | A | A-B | A-B | B | B |
| Lowest fixing temperature (° C.) | | 120 | 120 | 125 | 120 | 125 | 120 | 130 | 135 | 145 | 140 |
| Hot offset temperature (° C.) | | 230 | 230 | 230 | 230 | 230 | 230 | 235 | 235 | 235 | 235 |
| Pulverized particle (kg/H) | | 15 | 15 | 15 | 13 | 13 | 15 | 10 | 10 | 8 | 8 |

TABLE 3

| Channel | Particle size distribution | Ex. 11 | Ex. 12 | Ex. 13 | Ex. 14 | Ex. 15 | Ex. 16 | Comp. Ex. 1 | Comp. Ex. 2 | Comp. Ex. 3 | Comp. Ex. 4 |
|---|---|---|---|---|---|---|---|---|---|---|---|
| 1 | 1.26-1.59 (% by number) | 0.0 | 0.0 | 0.0 | 0.0 | 0.0 | 0.0 | 0.0 | 0.0 | 0.0 | 0.0 |
| 2 | 1.59-2.00 (% by number) | 0.0 | 0.0 | 0.0 | 0.0 | 0.0 | 0.0 | 0.0 | 0.0 | 0.0 | 0.0 |
| 3 | 2.00-2.52 (% by number) | 0.0 | 1.0 | 5.5 | 14.2 | 14.2 | 8.1 | 2.46 | 0.1 | 15.2 | 5.6 |
| 4 | 2.52-3.17 (% by number) | 6.8 | 9.8 | 12.4 | 15.4 | 15.4 | 20.8 | 6.15 | 5.5 | 20.1 | 16.2 |
| 5 | 3.17-4.00 (% by number) | 13.1 | 22.1 | 23.0 | 30.2 | 30.2 | 29.2 | 11.84 | 10.5 | 25.3 | 32.1 |
| 6 | 4.00-5.04 (% by number) | 15.2 | 23.9 | 29.2 | 32.6 | 32.6 | 36.6 | 15.94 | 11.3 | 34.4 | 40.2 |
| 7 | 5.04-6.35 (% by number) | 18.9 | 18.4 | 23.6 | 7.2 | 7.2 | 5.3 | 17.56 | 15.2 | 4.9 | 5.8 |
| 8 | 6.35-8.00 (% by number) | 24.2 | 16.7 | 5.0 | 0.4 | 0.4 | 0.0 | 26.24 | 29.2 | 0.2 | 0.0 |
| 9 | 8.00-10.10 (% by number) | 18.8 | 8.0 | 1.4 | 0.0 | 0.0 | 0.0 | 16.95 | 19.9 | 0.0 | 0.0 |
| 10 | 10.10-12.70 (% by number) | 3.0 | 0.2 | 0.0 | 0.0 | 0.0 | 0.0 | 2.70 | 8.2 | 0.0 | 0.0 |
| 11 | 12.70-16.00 (% by number) | 0.0 | 0.0 | 0.0 | 0.0 | 0.0 | 0.0 | 0.16 | 0.1 | 0.0 | 0.0 |
| 12 | 16.00-20.20 (% by number) | 0.0 | 0.0 | 0.0 | 0.0 | 0.0 | 0.0 | 0.00 | 0.0 | 0.0 | 0.0 |
| 13 | 20.20-25.40 (% by number) | 0.0 | 0.0 | 0.0 | 0.0 | 0.0 | 0.0 | 0.00 | 0.0 | 0.0 | 0.0 |
| 14 | 25.40-32.00 (% by number) | 0.0 | 0.0 | 0.0 | 0.0 | 0.0 | 0.0 | 0.00 | 0.0 | 0.0 | 0.0 |
| 15 | 32.00-40.30 (% by number) | 0.0 | 0.0 | 0.0 | 0.0 | 0.0 | 0.0 | 0.00 | 0.0 | 0.0 | 0.0 |
| 16 | 40.30-50.80 (% by number) | 0.0 | 0.0 | 0.0 | 0.0 | 0.0 | 0.0 | 0.00 | 0.0 | 0.0 | 0.0 |
| Number average particle diamter (D1) (μm) | | 6.2 | 5.13 | 4.4 | 3.7 | 3.7 | 3.8 | 6.1 | 6.7 | 3.6 | 3.9 |
| Variation coefficient A of the number distribution | | 34.9 | 34.9 | 30.1 | 26.1 | 26.1 | 23.3 | 35.9 | 34.9 | 25.3 | 21.6 |
| Variation coefficient B of the mass distribution | | 23.6 | 26.3 | 28.3 | 21.4 | 21.4 | 18.7 | 23.8 | 24.5 | 20.4 | 26.4 |
| Proportion of 4.00 to 8.00 μm particles (% by number) | | 58.4 | 59.0 | 57.7 | 40.2 | 40.2 | 41.9 | 59.7 | 55.6 | 39.4 | 46.1 |
| Weight average particle diameter (D4) (μm) | | 8.1 | 6.9 | 5.7 | 4.4 | 4.4 | 4.3 | 8.1 | 8.8 | 4.3 | 4.4 |
| D4/D1 | | 1.32 | 1.34 | 1.28 | 1.19 | 1.19 | 1.15 | 1.33 | 1.31 | 1.20 | 1.13 |
| Loose apparent density (LAD) (g/cm$^3$) | | 0.29 | 0.33 | 0.35 | 0.41 | 0.39 | 0.35 | 0.35 | 0.33 | 0.38 | 0.37 |
| Peak molecular weight (Mp) | | 8200 | 7800 | 3800 | 4000 | 4000 | 4000 | 7800 | 5500 | 4000 | 4000 |
| ½ flow temperature (° C.) | | 165 | 168 | 145 | 148 | 148 | 148 | 157 | 150 | 148 | 148 |
| Imgage density | | 1.39 | 1.41 | 1.42 | 1.48 | 1.50 | 1.45 | 1.31 | 1.35 | 1.25 | 1.34 |
| Non-uniformity in image density | | 0.09 | 0.08 | 0.09 | 0.04 | 0.02 | 0.03 | 0.15 | 0.09 | 0.08 | 0.22 |
| Sharpness | | 4 | 4-5 | 5 | 5 | 5 | 5 | 3 | 2 | 5 | 5 |
| Image fogging | | B | B | B | A-B | A | A | C | B | B | C |
| Removability of toner particles | | B | B | A | A | A | A | A | B | C | B |
| Lowest fixing temperature (° C.) | | 140 | 145 | 125 | 120 | 120 | 125 | 150 | 150 | 145 | 130 |
| Hot offset temperature (° C.) | | 235 | 235 | 230 | 230 | 230 | 230 | 235 | 230 | 230 | 230 |
| Pulverized particle (kg/H) | | 8 | 3 | 15 | 15 | 15 | 15 | 13 | 15 | 15 | 15 |

Synthesis Example 1B

-Synthesis of Polyester Resin 1B-

In a 2 L glass flask equipped with a thermometer, a stainless steel-stirrer, a falling film condenser and a nitrogen feed tube, the following ingredients were placed: 740 g of polyoxypropylene(2,2)-2,2-bis(4-hydroxyphl)propane; 300 g of polyoxyethylene(2,2)-2,2-bis(4-hydroxyphenyl)propane; 466 g of dimethyl terephthalate; 80 g of isododecenyl succinic anhydride; 114 g of tri n-butyl 1,2,4-benzenetricarboxylate; and, 10 g of tin(II) octylate. The flask was placed in an electric mantle heater to react the ingredients under a nitrogen gas environment at 210° C. The first half of the reaction was performed under normal pressure and the later half was performed under reduced pressure. The non-dissolved proportion of the resulting polyester resin in tetrahydrofuran was 25%. The peak top molecular weight thereof was 9,000 Thus, polyester resin 1B was obtained.

Synthesis Example 2B

-Synthesis of Polyester Resin 2B-

In a four-necked 3 L glass flask equipped with a thermometer, a stainless steel-stirrer, a falling film condenser and a nitrogen feed tube, the following ingredients were placed: 551 g of polyoxypropylene(2,2)-2,2-bis(4-hydroxyphl)propane; 463 g of polyoxyethylene(2,2)-2,2-bis(4-hydroxyphenyl)propane; 191; g of fumaric acid; 189 g 1,2,4-benzenetricarboxylic acid; and, 8 g of dioctane tin (II) oxide. The flask was then placed in the electric mantle heater to react the ingredients under a nitrogen gas environment at 210° C. The first half of the reaction was performed under normal pressure and the later half was performed under reduced pressure. The non-dissolved proportion of the resulting polyester resin in tetrahydrofuran was 8%. The peak top molecular weight thereof was 6,000. Thus, polyester resin 2B was obtained.

Synthesis Example 3B

-Synthesis of Hybrid Resin 1B-

In a dropping funnel, 410 g of styrene as a vinyl resin monomer, 90 g of 2-ethylhexyl acrylate, and 20 g of azobisisobutyronitrile as a polymerization initiator were placed.

In a four-necked 5 L glass flask equipped with a thermometer, a stainless steel-stirrer, a falling film condenser and a nitrogen feed tube, the following ingredients were placed: 780 g of polyoxypropylene(2,2)-2,2-bis(4-hydroxyphl)propane; 24 g of fumaric acid; 76 g of isododecenyl succinic anhydride; 250 g of terephthalic acid; and 5 g of tin (II) octylate. The flask was then placed in the electric mantle heater to stir the ingredients at 135° C. under a nitrogen gas environment. The vinyl resin monomer and polymerization initiator were added dropwise from the dropping funnel in 1 hour. Subsequently, the resulted mixture was aged at 135° C. for 2 hours, and then its ingredients were reacted at 230° C. The reaction was continued until when the softening point in accordance with ASTM E28-67 standard reached 120° C. Thus, hybrid resin 1B was obtained. The non-dissolved proportion of the hybrid resin 1B in tetrahydrofuran was 0%. The peak top molecular weight of the hybrid resin 1B was 8,300.

Synthesis Example 4B

-Synthesis of Styrene-Acrylate Resin 1B-

In an autoclave reaction vessel equipped with a thermometer, an agitator and a nitrogen feed tube, 200 parts of xylene was placed, and the vessel was purged with nitrogen gas. The vessel (and its contents) was heated to 170° C. Subsequently, in the vessel, the following ingredients were added dropwise in 3 hours: a mixture of 719.2 parts of styrene, 271.6 parts of n-butyl acrylate, and 9.2 parts of γ-methacryloxypropyl trimethoxysilane; 1.5 parts of di-t-butyl peroxide as a polymerization initiator; and the mixture of 5 parts of divinylbenzene and 100 parts of xylene as a cross-linking agent. Subsequently, the resulting mixture in the vessel was aged at 170° C. for 1 hour to complete its polymerization. Then, the thus obtained products was desolventized under reduced pressure. Thus, hybrid resin 1B was obtained. The non-dissolved proportion of the styrene-acrylate resin 1B in tetrahydrofuran was 20%. The peak top molecular weight of the styrene-acrylate resin 1B was 13,300.

Example 17

-Production of Toner B1-

70 parts of polyester resin 1B 5 parts of hybrid resin 1B 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 6.5 μm; the standard deviation of the number distribution was 2.27; the variation coefficient A of the number distribution (coefficient A was obtained by dividing the standard deviation of the number distribution by the number average particle diameter) was 35.0; the proportion of particles having a diameter in the range of 4.0 μm to 8.0 μm was 59% by number; and, the proportion of particles having a diameter in the range of 4.0 μm to 5.0 μm was 15% by number.

Using a sample mill, 2.0 parts of colloidal silica (H-2000, manufactured by Clariant (Japan) K. K.) and 100 parts of the toner base particles were mixed together. Thereby toner B1 was obtained. The thus obtained toner B1 had a ½ flow temperature of 165° C., peak top molecular weight of 9,000, and loose apparent density of 0.35 g/cm$^3$.

-Production of Developer 1-

The toner B1 and a silicone-coated carrier having a volume average particle diameter of 50 μm (where the added amount of the coat carrier was 5% of the total mass of the toner B1) were mixed together. Thus, developer B1 was obtained.

Example 18

-Production of Toner B2-

45 parts of polyester resin 1B 30 parts of hybrid resin 1B 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 4.1 μm; the standard deviation of the number distribution was 0.902; the variation coefficient A of the number distribution was 22.0; the proportion of particles having a diameter in the range of 4.0 μm to 8.0 μm was 47% by number; and, the proportion of particles having a diameter in the range of 4.0 μm to 5.0 μm was 30% by number.

Using a sample mill, 2.5 parts of colloidal silica (H-974, manufactured by Clariant (Japan) K. K.) and 100 parts of the toner base particles were mixed together. Thereby toner B2 was obtained. The thus obtained toner B2 had a ½ flow temperature of 155° C., peak top molecular weight of 7,200, and loose apparent density of 0.40 g/cm$^3$.

-Production of Developer B2-

The toner B2 and a silicone-coated carrier having a volume average particle diameter of 50 μm (where the added amount of the coat carrier was 5% of the total mass of the toner B2) were mixed together. Thus, developer B2 was obtained.

Example 19

-Production of Toner B3-

80 parts of polyester resin 2B 2 parts of PB34 (a chromium complex azo, manufactured by Orient Chemical Industries, LTD.)

8 parts of WEP-1 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 3.5 μm; the standard deviation of the number distribution was 1.015; the variation coefficient A of the number distribution was 29.0; the proportion of particles having a diameter in the range of 4.0 μm to 8.0 μm was 40% by number; and, the proportion of particles having a diameter in the range of 4.0 μm to 5.0 μm was 35% by number.

Using a sample mill, 1.5 parts of colloidal silica (H-30, manufactured by Clariant (Japan) K. K.) and 100 parts of the toner base particles were mixed together. Thereby toner B3 was obtained.

The thus obtained toner B3 had a ½ flow temperature of 145° C., peak top molecular weight of 6,000, and loose apparent density of 0.33 g/cm$^3$.

-Production of Developer B3-

The toner B3 and a silicone-coated carrier having a volume average particle diameter of 50 μm (where the added amount of the coat carrier was 5% of the total mass of the toner B3) were mixed together. Thus, developer B3 was obtained.

Example 20

-Production of Toner B4-

70 parts of polyester resin 1B 15 parts of hybrid resin 1B 5 parts of PB34 (a chromium complex azo, manufactured by Orient Chemical Industries, LTD.)

6 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 4.1 μm; the standard deviation of the number distribution was 1.06; the variation coefficient A of the number distribution was 25.9; the proportion of particles having a diameter in the range of 4.0 μm to 8.0 μm was 57% by number; and, the proportion of particles having a diameter in the range of 4.0 μm to 5.0 μm was 40% by number.

Using a sample mill, 0.8 parts of colloidal silica (H-2150, manufactured by Clariant (Japan) K. K.) and 100 parts of the toner base particles were mixed together. Thereby toner B4 was obtained. The thus obtained toner B4 had a ½ flow temperature of 155° C., peak top molecular weight of 8,300, and loose apparent density of 0.36 g/cm$^3$.

-Production of Developer B4-

The toner B4 and a silicone-coated carrier having a volume average particle diameter of 50 μm (where the added amount of the coat carrier was 5% of the total mass of the toner B4) were mixed together. Thus, developer B4 was obtained.

Example 21

-Production of Toner B5-

80 parts of styrene-acrylate resin 1B 5 parts of PB34 (a chromium complex azo, manufactured by Orient Chemical Industries, LTD.)

5 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 5.2 μm; the standard deviation of the number distribution was 1.30; the variation coefficient A of the number distribution was 25.0; the proportion of particles having a diameter in the range of 4.0 μm to 8.0 μm was 57% by number; and, the proportion of particles having a diameter in the range of 4.0 μm to 5.0 μm was 29% by number.

Using a sample mill, 1.5 parts of colloidal silica (H-2000, manufactured by Clariant (Japan) K. K.) and 100 parts of the toner base particles were mixed together. Thereby toner B5 was obtained. The thus obtained toner B5 had a ½ flow temperature of 155° C., peak top molecular weight of 9,800, and loose apparent density of 0.38 g/cm$^3$.

-Production of Developer B5-

The toner B5 and a silicone-coated carrier having a volume average particle diameter of 50 μm (where the added amount of the coat carrier was 5% of the total mass of the toner B5) were mixed together. Thus, developer B5 was obtained.

Example 22

-Production of Toner B6-

Using a sample mill, 0.5 parts of colloidal silica (OX50, manufactured by Clariant (Japan) K. K.) and 100 parts of the toner base particles 1 in Example 1 were mixed together. Thereby toner B6 was obtained.

The thus obtained toner B6 had a ½ flow temperature of 165° C., peak top molecular weight of 9,000, and loose apparent density of 0.31 g/cm$^3$.

-Production of Developer B6-

The toner B6 and a silicone-coated carrier having a volume average particle diameter of 50 μm (where the added amount of the coat carrier was 5% of the total mass of the toner B6) were mixed together. Thus, developer B6 was obtained.

Comparative Example 5

-Production of Toner B7-

55 parts of polyester resin 1B 20 parts of hybrid resin 1B 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 3.1 μm; the standard deviation of the number distribution was 0.65; the variation coefficient A of the number distribution was 21.0; the proportion of particles having a diameter in the range of 4.0 μm to 8.0 μm was 10% by number; and, the proportion of particles having a diameter in the range of 4.0 μm to 5.0 μm was 8% by number.

Using a sample mill, 3.0 parts of colloidal silica (H-2000, manufactured by Clariant (Japan) K. K.) and 100 parts of the toner base particles were mixed together. Thereby toner B7 was obtained. The thus obtained toner B1 had a ½ flow temperature of 160° C., peak top molecular weight of 7,800, and loose apparent density of 0.35 g/cm$^3$.

-Production of Developer B7-

The toner B7 and a silicone-coated carrier having a volume average particle diameter of 50 μm (where the added amount of the coat carrier was 5% of the total mass of the toner B7) were mixed together. Thus, developer B7 was obtained.

Comparative Example 6

-Production of Toner B8-

70 parts of polyester resin 2B 5 parts of styrene-acrylate resin 1B 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 6.9 μm; the standard deviation of the number distribution was 2.00; the variation coefficient A of the number distribution was 29.0; the proportion of particles having a diameter in the range of 4.0 μm to 8.0 μm was 59% by number; and, the proportion of particles having a diameter in the range of 4.0 μm to 5.0 μm was 10% by number.

Using a sample mill, 1.0 parts of colloidal silica (H-2000, manufactured by Clariant (Japan) K. K.) and 100 parts of the toner base particles were mixed together. Thereby toner B8 was obtained. The thus obtained toner B8 had a ½ flow temperature of 150° C., peak top molecular weight of 6,200, and loose apparent density of 0.34 g/cm$^3$.

-Production of Developer B8-

The toner B8 and a silicone-coated carrier having a volume average particle diameter of 50 μm (where the added amount of the coat carrier was 5% of the total mass of the toner B8) were mixed together. Thus, developer B8 was obtained.

Comparative Example 7

-production of Toner B9-

55 parts of polyester resin 1B 20 parts of hybrid resin 1B 5 parts of X-11 (a zirconium complex based on salicylic acid derivatives, manufactured by Orient Chemical Industries, LTD.)

10 parts of WEP-2 (an ester wax, manufactured by NOF CORPORATION)

10 parts of REGAL 330R (a carbon black, manufactured by CABOT Corporation)

The above-stated toner components were mixed together using FM10B (a Henschel mixer manufactured by MITSUI MIIKE MACHINERY CO., LTD.). The thus obtained mixture was kneaded with PCM-30 (a twin-shaft kneader manufactured by Ikegai Tekko Co., Ltd.). The thus obtained kneaded product was pulverized with LAB JET Supersonic Jet Pulverizer (manufactured by Nippon Pneumatic Mfg. Co., Ltd.). The thus obtained particles were classified with MDS-I (a stream classifier manufactured by Nippon Pneumatic Mfg. Co., Ltd.). Thereby toner base particles were obtained.

The characteristics of the toner base particles are as follows: the number average particle diameter was 5.7 μm; the standard deviation of the number distribution was 2.07; the variation coefficient A of the number distribution was 36.4; the proportion of particles having a diameter in the range of 4.0 μm to 8.0 μm was 68% by number; and, the proportion of particles having a diameter in the range of 4.0 μm to 5.0 μm was 32% by number.

Using a sample mill, 1.0 part of colloidal silica (H-2000, manufactured by Clariant (Japan) K. K.) and 100 parts of the toner base particles were mixed together. Thereby toner B8 was obtained. The thus obtained toner B1 had a ½ flow temperature of 148° C., peak top molecular weight of 7,500, and loose apparent density of 0.35 g/cm$^3$.

-Production of Developer B9-

The toner B9 and a silicone-coated carrier having a volume average particle diameter of 50 μm (where the added amount of the coat carrier was 5% of the total mass of the toner B9) were mixed together. Thus, developer B9 was obtained.

<Evaluation>

The thus obtained developers were used in Imagio NEO 4532 (an image forming apparatus where toner particles are collected to be re-supplied, manufactured by Ricoh Company, Ltd.) to evaluate their properties in accordance with the following methods/criteria. The results are shown in Table 4.

<Image Forming>

The following evaluations were conducted after 100,000 sheets of paper were printed with Imagio NEO 4532 under room temperature/humidity, 25° C./60% relative humidity.

<Sharpness>

A Chinese character, 「電」 was formed to the full extent of a 2 mm by 2 mm area on paper. The character was magnified by 30 times to evaluate its sharpness using the grading criteria shown in FIG. 7. Rank 2 (4) sharpness is in the middle between 1 and 3 (3 and 5).

<Image Density>

A solid black circle having a diameter of 3 cm was formed on paper. The image density was found by measuring the average density of ten different spots in the circle with a Macbeth densitometer.

<Non-Uniformity in Image Density>

The non-uniformity in image density was found by calculating the difference between the maximum and minimum densities among the densities of the ten different spots in the solid black circle.

<Image Fogging>

The occurrences of image fogging were rated using the following evaluation criteria:

A: Image fogging was not recognized

B: Image fogging was recognized in some degree, while it was acceptable to practical use.

C: Image fogging was recognized/unacceptable in practical use

TABLE 4

| | Ex. 17 | Ex. 18 | Ex. 19 | Ex. 20 | Ex. 21 | Ex. 22 | Comp. Ex. 5 | Comp. Ex. 6 | Comp. Ex. 7 |
|---|---|---|---|---|---|---|---|---|---|
| Sharpness | 5 | 4 | 4 | 4 | 4 | 5 | 5 | 3 | 2 |
| Image Density | 1.46 | 1.38 | 1.40 | 1.39 | 1.42 | 1.42 | 1.25 | 1.35 | 1.30 |
| Non-uniformity in Image Density | 0.01 | 0.06 | 0.04 | 0.03 | 0.02 | 0.06 | 0.18 | 0.03 | 0.20 |
| Image Fogging | A | A | B | B | A | B | C | B | C |

INDUSTRIAL APPLICABILITY

The toner of the present invention and the two-component developer using the same are suitably used in electrophotographic image forming systems as means for providing high quality images. They are used in a variety of applications including full-color copiers with direct- or indirect-electrophotographic developing, full-color laser printers, and full-color fax machines in which regular paper is used.

The invention claimed is:

1. A toner, comprising:

a colorant, a releasing agent, and a binder resin, wherein a number average particle diameter (D1) of the toner is in a range 3.5 μm to 6.5 μm as determined by the Coulter method, wherein a variation coefficient of a number distribution of the toner is in the range of 22.0 to 35.0, the variation coefficient being found by dividing a standard deviation of the number distribution by the number average particle diameter (D1), wherein 40% by number to 59% by number of the toner are 4.0 μm to 8.0 μm in diameter, wherein a ratio of D4 to D1 is in a range of 1.04 to 1.34, where D4 is a weight average particle diameter, and wherein a loose apparent density of the toner is in a range of 0.29 g/cm$^3$ to 0.39 g/cm$^3$.

2. The toner according to claim 1, wherein 15% by number to 35% by number of the toner are 4.0 μm to 5.0 μm in diameter.

3. The toner according to claim 1, wherein the weight average particle diameter (D4) of the toner is in a range of 3.5 μm to 5.5 μm.

4. The toner according to claim 1, wherein the binder resin contains a polyester resin produced by using an inorganic tin (II) compound as a catalyst, and wherein a peak top molecular weight (Mp) of the toner is in a range of 4,000 to 8,000, as determined by gel permeation chromatography (GPC).

5. The toner according to claim 4, wherein the inorganic tin (II) compound is tin (II) octylate.

6. The toner according to claim 1, wherein a ½ flow temperature of the toner is in a range of 145° C. to 165° C., the ½ flow temperature being determined with a flow tester.

7. The toner according to claim 1, wherein the binder resin contains a hybrid resin composed of a vinyl polymerization unit and a polyester unit that is produced by using an inorganic tin (II) compound as a catalyst, and wherein a content A of the hybrid resin and a content B of the releasing agent satisfy a condition:

$$(1/2)\times B \leqq A \leqq 3B.$$

8. A two-component developer, comprising:

a toner; and a carrier, wherein the toner includes a colorant, a releasing agent, and a binder resin, wherein a number average particle diameter (D1) of the toner is in a range of 3.5 μm to 6.5 μm as determined by the Coulter method, wherein a variation coefficient of a number distribution of the toner is in the range of 22.0 to 35.0, the variation coefficient being found by dividing a standard deviation of the number distribution by the number average particle diameter (D1), wherein 40% by number to 59% by number of the toner are 4.0 μm to 8.0 μm in diameter, wherein a ratio of D4 to D1 is in a range of 1.04 to 1.34, where D4 is a weight average particle diameter, and wherein a loose apparent density of the toner is in a range of 0.29 g/cm$^3$ to 0.39 g/cm$^3$.

9. An image forming method, comprising:

charging a surface of an image bearing member;

exposing the surface to form a latent electrostatic image;

developing the latent electrostatic image into a visible image with a toner;

transferring the visible image to a recording medium;

fixing the visible image onto the recording medium; and removing remaining toner from the surface, wherein the toner includes a colorant, a releasing agent, and a binder resin, wherein a number average particle diameter (D1) of the toner is in a range of 3.5 μm to 6.5 μm as determined by the Coulter method, wherein a variation coefficient of a number distribution of the toner is in the range of 22.0 to 35.0, the variation coefficient being found by dividing a standard deviation of the number distribution by the number average particle diameter (D1), wherein 40% by number to 59% by number of the toner are 4.0 μm to 8.0 μm in diameter, wherein a ratio of D4 to D1 is in a range of 1.04 to 1.34, where D4 is a weight average particle diameter, and wherein a loose apparent density of the toner is in a range of 0.29 g/cm$^3$ to 0.39 g/cm$^3$.

10. The image forming method according to claim 9, further comprising collecting removed toner to reuse the removed toner in developing a latent electrostatic image.

11. The image forming method according to claim 9, wherein the recording medium is fed in between a fixing roller and a pressure roller to fix the visible image, the fixing roller applying heat to the recording medium to fix the visible image, a wall thickness of the fixing roller being 1.0 mm or thinner, and wherein pressure applied to a unit area of a surface of one of the fixing roller and the pressure roller by a surface of the other of the fixing roller and the pressure roller is $1.5\times10^5$ Pa or less, where the pressure is calculated by dividing load between the fixing roller and the pressure roller by a contact area thereof.

12. The image forming method according to claim 9, wherein the removing of the remaining toner is performed with a cleaning unit configured to clean the surface of the image bearing member, the cleaning unit comprising a first cleaning blade and a second cleaning blade which are located upstream and downstream, respectively, of a rotation direction of the image bearing member, wherein the second cleaning blade including a base and an abrasive particle-containing layer as a sanding blade.

* * * * *